US011104135B2

(12) United States Patent
Kanegae et al.

(10) Patent No.: US 11,104,135 B2
(45) Date of Patent: Aug. 31, 2021

(54) LIQUID DISCHARGING APPARATUS

(71) Applicant: SEIKO EPSON CORPORATION, Tokyo (JP)

(72) Inventors: Takahiro Kanegae, Shiojiri (JP); Nobuaki Ito, Shiojiri (JP); Atsushi Muto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/001,968

(22) Filed: Aug. 25, 2020

(65) Prior Publication Data

US 2021/0060939 A1 Mar. 4, 2021

(30) Foreign Application Priority Data

Aug. 29, 2019 (JP) ..... JP2019-156760

(51) Int. Cl.
*B41J 2/145* (2006.01)
*B41J 2/21* (2006.01)

(52) U.S. Cl.
CPC ..... *B41J 2/145* (2013.01); *B41J 2/21* (2013.01)

(58) Field of Classification Search
CPC ..... B41J 2/145; B41J 2/21
See application file for complete search history.

(56) References Cited

U.S. PATENT DOCUMENTS

2015/0174918 A1* 6/2015 Tajima ..... B41J 2/2117 347/102
2018/0281445 A1* 10/2018 Nishio ..... B41J 2/1707

FOREIGN PATENT DOCUMENTS

JP 2017-136720 8/2017

* cited by examiner

*Primary Examiner* — Lamson D Nguyen
(74) *Attorney, Agent, or Firm* — Workman Nydegger

(57) ABSTRACT a part of a first head is positioned in the second part, a part of a second head is positioned in the third part, a part of a third head is positioned in the fifth part, a part of a fourth head is positioned in the sixth part, and a first color is cyan and a third color is magenta.

12 Claims, 19 Drawing Sheets

LIQUID DISCHARGING APPARATUS

The present application is based on, and claims priority from JP Application Serial Number 2019-156760, filed Aug. 29, 2019, the disclosure of which is hereby incorporated by reference herein its entirety.

BACKGROUND

1. Technical Field

The present disclosure relates to a liquid discharging apparatus.

2. Related Art

JP-A-2017-136720 describes a liquid discharging apparatus that discharges a liquid such as ink. The liquid discharging apparatus described in JP-A-2017-136720 has a plurality of liquid ejecting units which are a plurality of head units. Each head unit includes a plurality of heads, specifically, a plurality of driving portions. Each of the plurality of heads discharges a liquid. The plurality of heads include two heads in which positions in a first direction are different from each other. Positions of the two heads in a second direction intersecting with the first direction are also different from each other.

In a liquid discharging apparatus having a plurality of head units, a situation may occur in which one of the head units is mounted at a position different from the designed mounting position, for example, a position rotated from the designed mounting position due to a mounting error or the like of the head units. This situation causes deterioration in quality of a formed object such as an image formed by the liquid discharged by the head.

Such deterioration in quality is likely to be remarkable in a liquid discharging apparatus including a plurality of head units which are provided with two heads having different positions in the first direction and different positions in the second direction, as in the liquid discharging apparatus described in JP-A-2017-136720.

Therefore, a technique capable of reducing the above-described deterioration in quality is required for a liquid discharging apparatus including a plurality of head units which are provided with two heads having different positions in the first direction and different positions in the second direction.

SUMMARY

According to an aspect of the present disclosure, to solve the above problems, there is provided a liquid discharging apparatus for discharging a liquid, including: a first head unit including a first head that is provided with a plurality of first nozzles that discharge the liquid of a first color and a plurality of second nozzles that discharge the liquid of a second color, and a second head that is provided with a plurality of third nozzles that discharge the liquid of the first color and a plurality of fourth nozzles that discharge the liquid of the second color; and a second head unit including a third head that is provided with a plurality of fifth nozzles that discharge the liquid of a third color and a plurality of sixth nozzles that discharge the liquid of a fourth color, and a fourth head that is provided with a plurality of seventh nozzles that discharge the liquid of the third color and a plurality of eighth nozzles that discharge the liquid of the fourth color, in which the first head unit has a first part, a second part that is coupled to the first part on a first side in a first direction and has a width shorter than a width of the first part in a second direction intersecting the first direction, and a third part that is coupled to the first part on a second side opposite to the first side in the first direction, has a width shorter than the width of the first part in the second direction, and is provided at a position different from the second part in the second direction, the second head unit has a fourth part, a fifth part that is coupled to the fourth part on the first side in the first direction and has a width shorter than a width of the fourth part in the second direction, and a sixth part that is coupled to the fourth part on the second side in the first direction, has a width shorter than the width of the fourth part in the second direction, and is provided at a position different from the fifth part in the second direction, a part of the first head is positioned in the second part, a part of the second head is positioned in the third part, a part of the third head is positioned in the fifth part, a part of the fourth head is positioned in the sixth part, and the first color is cyan and the third color is magenta.

DESCRIPTION OF EXEMPLARY EMBODIMENTS

Figure 2:
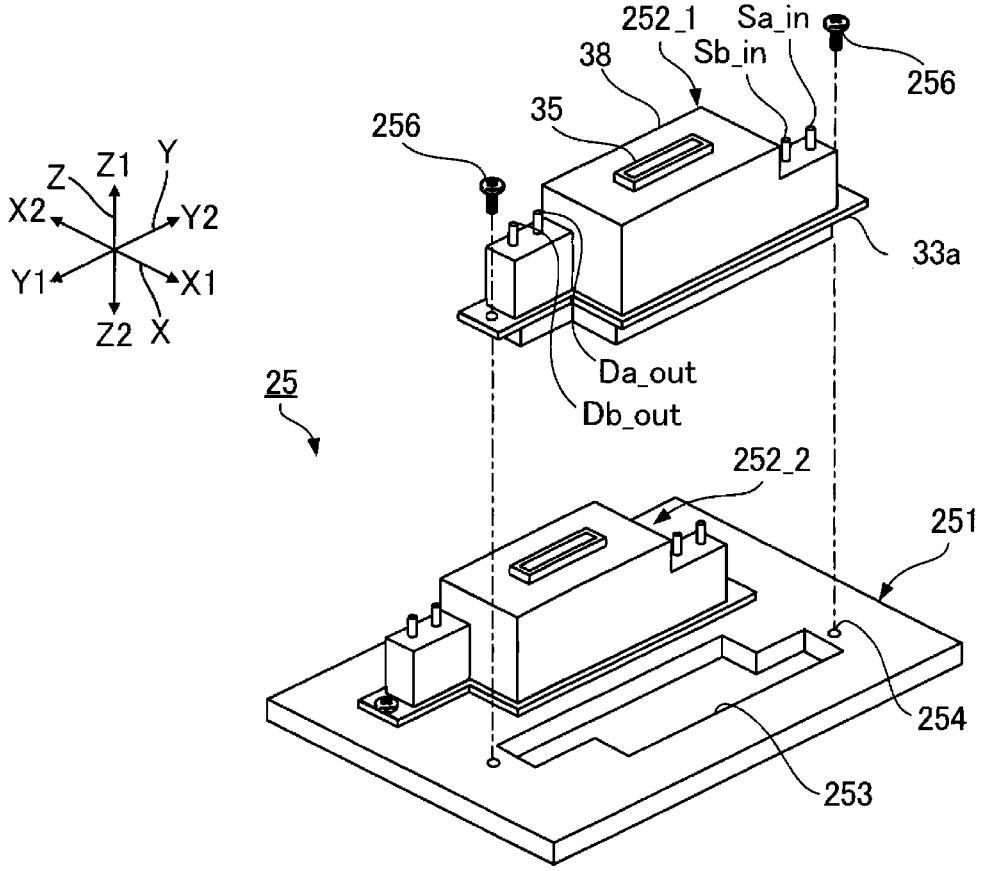
FIG. 2 is a perspective view of a head module.

In the following description, an X axis, a Y axis, and a Z axis that are orthogonal to each other are assumed. As illustrated in FIG. 2, a direction along the X axis when viewed from any point is represented as an X1 direction, and a direction opposite to the X1 direction is represented as an X2 direction. Similarly, directions opposite to each other along the Y axis from any point are represented as Y1 and Y2 directions, and directions opposite to each other along the Z axis from any point are represented as Z1 and Z2 directions. An XY plane including the X axis and the Y axis corresponds to a horizontal plane. The Z axis is an axis along the vertical direction, and the Z2 direction corresponds to a lower side in the vertical direction. The X axis, the Y axis, and the Z axis may intersect each other at an angle of approximately 90 degrees.

In the following description, the Y1 direction corresponds to "a first direction". The X1 direction intersecting the Y1 direction corresponds to "a second direction". The Y1 direction and the X1 direction are orthogonal to each other. One corresponds to "a first side" and the other corresponds to "a second side" with respect to any point along the axis along the Y1 direction. "a first side in a Y1 direction" corresponds to the Y2 direction. "a second side opposite to a first side in a Y1 direction" corresponds to the Y1 direction. One corresponds to "a third side" and the other corresponds to "a fourth side" with respect to any point along the axis along the X1 direction. "a third side in an X1 direction" corresponds to the X2 direction. "a fourth side opposite to a third side in an X1 direction" corresponds to the X1 direction.

1. First Embodiment

1-1. Liquid Discharging Apparatus 100

Figure 1:
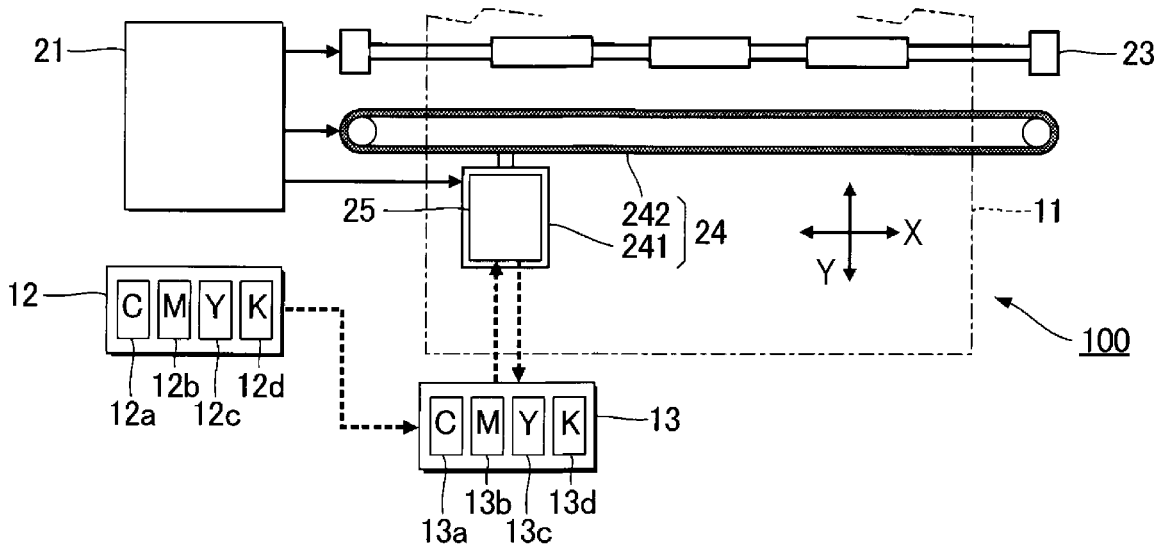
FIG. 1 is a schematic view illustrating a configuration of a liquid discharging apparatus according to a first embodiment.

FIG. 1 is a schematic view illustrating a configuration of a liquid discharging apparatus 100 according to a first embodiment. The liquid discharging apparatus 100 is an ink jet type printing apparatus that discharges ink, which is an example of a liquid, as droplets onto a medium 11. The medium 11 is typically a printing paper. However, a printing target object made of any material such as a resin film or cloth may be used as the medium 11, for example.

The liquid discharging apparatus 100 is provided with a liquid container 12 that stores the ink. For example, a cartridge that is attachable to and detachable from the liquid discharging apparatus 100, a bag-shaped ink pack made of a flexible film, or an ink tank that can be replenished with ink is used as the liquid container 12.

The liquid container 12 includes a first liquid container 12*a*, a second liquid container 12*b*, a third liquid container 12*c*, and a fourth liquid container 12*d*. The cyan ink C is stored in the first liquid container 12*a*. The magenta ink M is stored in the second liquid container 12*b*. The yellow ink Y is stored in the third liquid container 12*c*. The black ink K is stored in the fourth liquid container 12*d*. Cyan corresponds to a first color. Yellow corresponds to a second color. Magenta corresponds to a third color. Black corresponds to a fourth color. The yellow may correspond to the fourth color and the black may correspond to the second color.

The liquid discharging apparatus 100 is provided with a sub tank 13 that temporarily stores ink. The ink supplied from the liquid container 12 is stored in the sub tank 13. The sub tank 13 includes a first sub tank 13*a* in which the cyan ink C is stored, a second sub tank 13*b* in which the magenta ink M is stored, a third sub tank 13*c* in which the yellow ink Y is stored, and a fourth sub tank 13*d* in which the black ink K is stored. The first sub tank 13*a* is coupled to the first liquid container 12*a*. The second sub tank 13*b* is coupled to the second liquid container 12*b*. The third sub tank 13*c* is coupled to the third liquid container 12*c*. The fourth sub tank 13*d* is coupled to the fourth liquid container 12*d*. The sub tank 13 is coupled to the head module 25. The sub tank 13 supplies ink to the head module 25 and collects the ink from the head module 25.

The liquid discharging apparatus 100 is provided with a control unit 21, a transporting mechanism 23, a moving mechanism 24, and the head module 25. The control unit 21 controls each element of the liquid discharging apparatus 100. The control unit 21 includes, for example, one or a plurality of processing circuits such as a central processing unit (CPU) or a field programmable gate array (FPGA), and one or a plurality of storage circuits such as a semiconductor memory.

The transporting mechanism 23 transports a medium 11 along the Y axis under the control of the control unit 21. The moving mechanism 24 causes the head module 25 reciprocates along the X axis under the control of the control unit 21. The moving mechanism 24 is provided with a substantially box-shaped transporting body 241 that accommodates the head module 25, and an endless belt 242 to which the transporting body 241 is fixed. The liquid container 12 and the sub tank 13 may be mounted on the transporting body 241 together with the head module 25 as the moving mechanism 24.

The head module 25 discharges the ink which is supplied from the sub tank 13, from each of a plurality of nozzles onto the medium 11 under the control of the control unit 21. The head module 25 discharges the ink onto the medium 11 in parallel with the transport of the medium 11 by the transporting mechanism 23 and the repeated reciprocation of the transporting body 241, thereby an image is formed on a surface of the medium 11. The ink that has not been discharged from the plurality of nozzles is exhausted to the sub tank 13.

The sub tank 13 constitutes a part of an external flow path portion (not illustrated) installed outside the head module 25. The external flow path portion is provided with a flow path that couples the head module 25 and the sub tank 13, a circulation pump for sending the ink from the head module 25 to the sub tank 13, and the like.

1-2. Head Module 25

FIG. 2 is a perspective view of the head module 25. The head module 25 is provided with a support body 251, a first head unit 252_1, and a second head unit 252_2. The cyan ink C and the yellow ink Y are supplied to the first head unit 252_1. The magenta ink M and the black ink K are supplied to the second head unit 252_2. When it is not necessary to distinguish the first head unit 252_1 and the second head unit 252_2 from each other, these are referred to as "head unit 252".

The support body 251 is a plate-shaped member that supports the plurality of head units 252. A plurality of mounting holes 253 and a plurality of screw holes 254 are formed at the support body 251. Each head unit 252 is supported by the support body 251 in a state inserted into the mounting hole 253. The plurality of screw holes 254 are provided in twos for each of the mounting holes 253. Each head unit 252 is fixed to the support body 251 at two places by screwing using screws 256 and screw holes 254. The position of screwing is not limited to the position illustrated in FIG. 2. Each head unit 252 is fixed to the support body 251 at one place or three or more places by screwing using screws 256 and screw holes 254. Each head unit 252 and the support body 251 may be fixed by a method other than screwing. For example, each head unit 252 may be fixed to the support body 251 with an adhesive. The number of head units 252 is not limited to the above examples. However, the number of head units 252 is two or more, and at least the first head unit 252_1 and the second head unit 252_2 are included in the liquid discharging apparatus 100. The arrangement form of the plurality of head units 252 is not limited to the above example. For example, another head unit 252 may be positioned between the first head unit 252_1 and the second head unit 252_2.

1-3. First Head Unit 252_1

Figure 3:
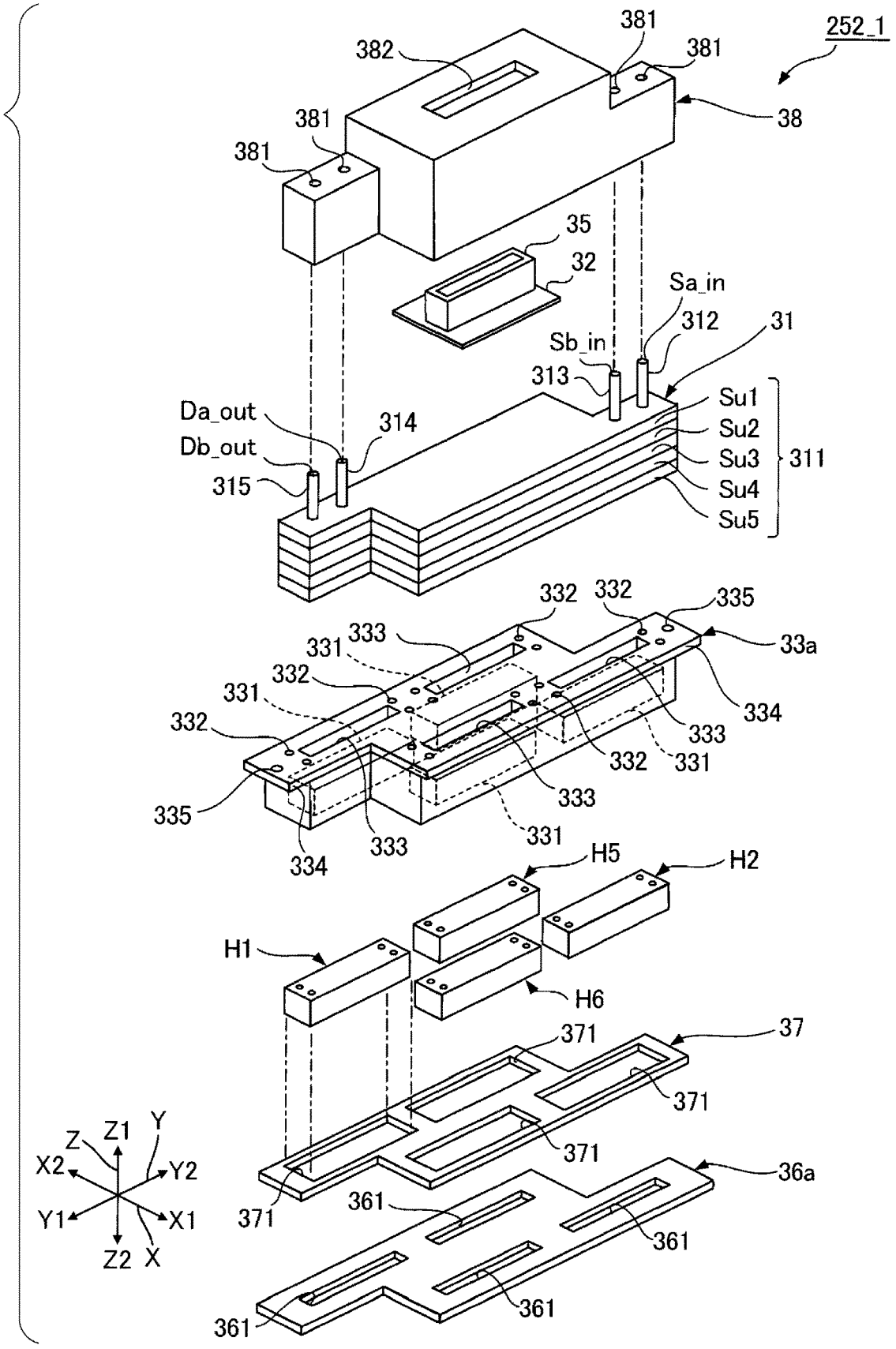
FIG. 3 is a disassembled perspective view of a first head unit.

FIG. 3 is a disassembled perspective view of the first head unit 252_1. The first head unit 252_1 includes a flow path member 31, a wiring substrate 32, a first holder 33*a*, a first head H1, a second head H2, a fifth head H5, a sixth head H6, a first fixing plate 36*a*, a reinforcing plate 37, and a cover 38. A third head H3, a fourth head H4, a seventh head H7, and an eighth head H8 will be described later. The first head H1, the second head H2, the fifth head H5, and the sixth head H6 have the same configuration with each other. When it is not necessary to distinguish the first head H1, the second head H2, the fifth head H5, and the sixth head H6 from each other, these are referred to as "head Hn".

The flow path member 31 is positioned between the wiring substrate 32 and the first holder 33*a*. The flow path member 31 is a member in which a flow path through which the ink flows, is formed. The flow path member 31 includes a flow path structure 311 and coupling pipes 312, 313, 314, and 315.

Although not illustrated in FIG. 3, the flow path structure 311 of the first head unit 252_1 is provided with a supply flow path for supplying the cyan ink C to the plurality of heads Hn, a supply flow path for supplying the yellow ink Y to the plurality of heads Hn, an exhaust flow path for exhausting the cyan ink C from the plurality of heads Hn, and an exhaust flow path for exhausting the yellow ink Y from the plurality of heads Hn.

The flow path structure 311 is constituted by laminating the plurality of substrates Su1 to Su5. The plurality of substrates Su1 to Su5 are formed by injection molding of a resin material, for example. The plurality of substrates Su1 to Su5 are bonded to each other by, for example, an adhesive. The flow path structure 311 has a longitudinal shape along the Y axis. The flow path structure 311 is provided with coupling pipes 312 to 315.

Each of the coupling pipes 312, 313, 314, and 315 protrudes from the flow path structure 311 in the Z1 direction. The coupling pipe 312 is a supply pipe provided with a supply port Sa_in for supplying the cyan ink C to the flow path structure 311. The coupling pipe 313 is a supply pipe provided with a supply port Sb_in for supplying the yellow ink Y to the flow path structure 311. The coupling pipe 314 is an exhaust pipe provided with an exhaust port Da_out for exhausting the cyan ink C from the flow path structure 311. The coupling pipe 315 is an exhaust pipe provided with an exhaust port Db_out for exhausting the yellow ink Y from the flow path structure 311.

The wiring substrate 32 is a mounting component for electrically coupling the head unit 252 to the control unit 21. The wiring substrate 32 is formed of, for example, a flexible wiring substrate, a rigid wiring substrate, or the like. The wiring substrate 32 is disposed on the surface of the flow path member 31. A connector 35 is installed on the wiring substrate 32. The connector 35 is a coupling component for electrically coupling the head unit 252 and the control unit 21. Although not illustrated, wirings coupled to the plurality of heads Hn are coupled to the wiring substrate 32. The wiring may be integrated with the wiring substrate 32.

The first holder 33*a* is a structure that accommodates and supports the plurality of heads Hn. The first holder 33*a* is made of, for example, a resin material or a metal material or the like. The first holder 33*a* is provided with a plurality of recess portions 331, a plurality of ink holes 332, a plurality of wiring holes 333, and a pair of flanges 334. Each of the plurality of recess portions 331 is a space that opens in the Z2 direction and in which the head Hn is disposed. Each of the plurality of ink holes 332 is a flow path through which the ink flows between the head Hn and the flow path member 31. Each of the plurality of wiring holes 333 is a hole through which a wiring (not illustrated) that couples the head Hn and the wiring substrate 32 is passed. The flange 334 is a fixing portion for fixing the first holder 33*a* to the support body 251. The flange 334 is provided with holes 335 for screwing to the support body 251. The screw 256 illustrated in FIG. 2 is passed through the hole 335.

Each head Hn discharges the ink supplied from the flow path member 31. Although not illustrated in FIG. 3, each head Hn has a plurality of nozzles that discharge the cyan ink C and a plurality of nozzles that discharge the yellow ink Y.

The first fixing plate 36*a* is a plate member for fixing the plurality of heads Hn to the first holder 33*a*. The first fixing plate 36*a* is disposed so as to interpose the plurality of heads Hn between the first fixing plate 36*a* and the first holder 33*a*, and is fixed to the first holder 33*a* with an adhesive. The first fixing plate 36*a* is made of, for example, a metal material or the like. The first fixing plate 36*a* is provided with a plurality of opening portions 361 for exposing the nozzles of the plurality of heads Hn. In the example of FIG. 3, the plurality of opening portions 361 are individually provided for each head Hn. The opening portion 361 may be shared by two or more heads Hn.

The reinforcing plate 37 is disposed between the first holder 33*a* and the first fixing plate 36*a*, and is fixed to the first fixing plate 36*a* with an adhesive. Therefore, the reinforcing plate 37 reinforces the first fixing plate 36*a*. The reinforcing plate 37 is provided with a plurality of opening portions 371 in which the plurality of heads Hn are disposed. The reinforcing plate 37 is made of, for example, a metal material or the like. From the viewpoint of reinforcing the first fixing plate 36*a*, the thickness of the reinforcing plate 37 is desirably larger than the thickness of the first fixing plate 36*a*.

The cover 38 is a box-shaped member that accommodates the flow path structure 311 and the wiring substrate 32. The cover 38 is made of, for example, a resin material or the like. The cover 38 is provided with four through holes 381 and an opening portion 382. The coupling pipe 312, 313, 314, or 315 is inserted into the respective through holes 381. The connector 35 is inserted into the opening portion 382.

Figure 4:
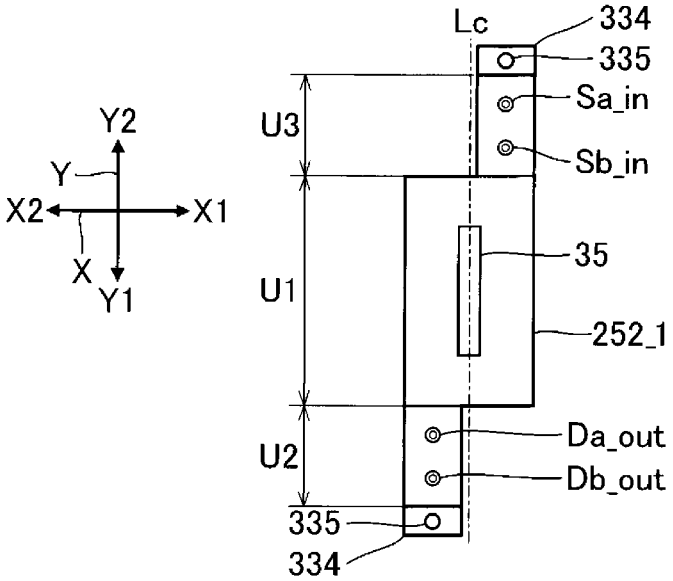
FIG. 4 is a plan view of the first head unit as viewed from a Z1 direction.

FIG. 4 is a plan view of the first head unit 252_1 as viewed from the Z1 direction. The first head unit 252_1 has a first part U1, a second part U2, and a third part U3. Each of the first part U1, the second part U2, and the third part U3 has a quadrangular shape in which a longitudinal direction is the Y1 direction when viewed from the Z1 direction. The first part U1 is positioned between the second part U2 and the third part U3.

Specifically, the second part U2 is positioned in the Y1 direction with respect to the first part U1, and the third part U3 is positioned in the Y2 direction with respect to the first part U1.

In FIG. 4, a center line Lc, which is a line segment passing through a center of the first part U1 along the Y axis, is illustrated. The center line Lc is also a line segment passing through the geometric center of gravity of the first head unit 252_1 along the Y axis. The second part U2 is positioned in the X2 direction with respect to the center line Lc. The third part U3 is positioned in the X1 direction with respect to the center line Lc. That is, the second part U2 and the third part U3 are positioned on opposite sides of the X axis with the center line Lc interposed therebetween.

Figure 5:
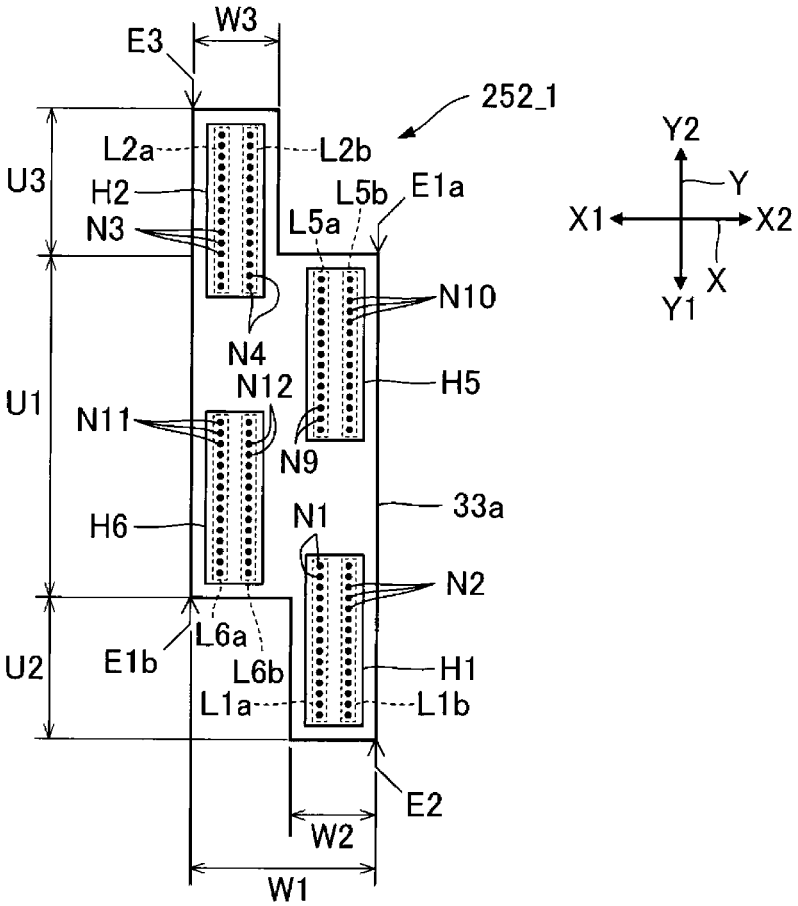
FIG. 5 is a plan view of the first head unit as viewed from a Z2 direction.

FIG. 5 is a plan view of the first head unit 252_1 as viewed from the Z2 direction. In FIG. 5, the flange 334, the first fixing plate 36*a*, and the reinforcing plate 37 are omitted for convenience of description. The first head H1 is disposed across the first part U1 and the second part U2. The second head H2 is disposed across the first part U1 and the third part U3. The fifth head H5 and the sixth head H6 are disposed in the first part U1. The first head H1 and the fifth head H5 are positioned in the X2 direction with respect to the center line Lc. The second head H2 and the sixth head H6 are positioned in the X1 direction with respect to the center line Lc. A part of the first head H1 and a part of the sixth head H6 overlap with each other in the Y axis.

A part of the sixth head H6 and a part of the fifth head H5 overlap with each other in the Y axis. A part of the fifth head H5 and a part of the second head H2 overlap with each other in the Y axis.

The position of the first head H1 in the X1 direction is different from the position of the second head H2 in the X1 direction. The position of the first head H1 in the Y1 direction is different from the position of the second head H2 in the Y1 direction.

The position of the first head H1 in the X1 direction is the same as the position of the fifth head H5 in the X1 direction. The position of the first head H1 in the Y1 direction is different from the position of the fifth head H5 in the Y1 direction.

The position of the first head H1 in the X1 direction is different from the position of the sixth head H6 in the X1 direction. The position of the first head H1 in the Y1 direction is different from the position of the sixth head H6 in the Y1 direction.

The position of the second head H2 in the X1 direction is different from the position of the fifth head H5 in the X1 direction. The position of the second head H2 in the Y1 direction is different from the position of the fifth head H5 in the Y1 direction.

The position of the second head H2 in the X1 direction is the same as the position of the sixth head H6 in the X1 direction. The position of the second head H2 in the Y1 direction is different from the position of the sixth head H6 in the Y1 direction.

The width W2 of the second part U2 along the X axis is shorter than the width W1 of the first part U1 along the X axis. The width W3 of the third part U3 along the X axis is shorter than the width W1 of the first part U1 along the X axis. The width W2 and the width W3 are equal to each other. The width W2 and the width W3 may be different from each other. However, when the width W2 and the width W3 are equal to each other, the symmetry of the shape of the first head unit 252_1 can be enhanced. As a result, there is an advantage that the plurality of head units 252 can be easily arranged closely. The widths W1, W2, and W3 of the first part U1, the second part U2, and the third part U3 are the widths between one end portion and the other end portion along the X axis of each part.

An end surface E1*a* of the first part U1 in the X2 direction is a plane continuous with an end surface E2 of the second part U2 in the X2 direction. An end surface E1*b* of the first part U1 in the X1 direction is a plane continuous with an end surface E3 of the third part U3 in the X1 direction. A recess portion or a projection portion may be appropriately provided on these end surfaces. Further, a step may be provided between the end surface E1*a* and the end surface E2, and a step may be provided between the end surface E1*b* and the end surface E3.

The first head H1 is provided with a nozzle row Lia and a nozzle row Lib. Each of the nozzle row Lia and the nozzle row Lib is a set of the plurality of nozzles N arranged along the Y axis. The nozzle row Lia and the nozzle row Lib are provided side by side with an interval in between in the direction of the X axis. The nozzle row Lia is constituted by a plurality of first nozzles N1. Each of the plurality of first nozzles N1 discharges the cyan ink C. The nozzle row Lib is constituted by a plurality of second nozzles N2. Each of the plurality of second nozzles N2 discharges the yellow ink Y.

The second head H2 is provided with a nozzle row L2*a* and a nozzle row L2*b*. Each of the nozzle row L2*a* and the nozzle row L2*b* is a set of the plurality of nozzles N arranged along the Y axis. The nozzle row L2*a* and the nozzle row L2*b* are provided side by side with an interval in between in the direction of the X axis. The nozzle row L2*a* is constituted by a plurality of third nozzles N3. Each of the plurality of third nozzles N3 discharges the cyan ink C. The nozzle row L2*b* is constituted by a plurality of fourth nozzles N4. Each of the plurality of fourth nozzles N4 discharges the yellow ink Y.

The fifth head H5 is provided with a nozzle row L5*a* and a nozzle row L5*b*. Each of the nozzle row L5*a* and the nozzle row L5*b* is a set of the plurality of nozzles N arranged along the Y axis. The nozzle row L5*a* and the nozzle row L5*b* are provided side by side with an interval in between in the direction of the X axis. The nozzle row L5*a* is constituted by a plurality of ninth nozzles N9. Each of the plurality of ninth nozzles N9 discharges the cyan ink C. The nozzle row L5*b* is constituted by a plurality of tenth nozzles N10. Each of the plurality of tenth nozzles N10 discharges the yellow ink Y.

The sixth head H6 is provided with a nozzle row L6*a* and a nozzle row L6*b*. Each of the nozzle row L6*a* and the nozzle row L6*b* is a set of the plurality of nozzles N arranged along the Y axis. The nozzle row L6*a* and the nozzle row L6*b* are provided side by side with an interval in between in the direction of the X axis. The nozzle row L6*a* is constituted by a plurality of eleventh nozzles N11. Each of the plurality of eleventh nozzles N11 discharges the cyan ink C. The nozzle row L6*b* is constituted by a plurality of twelfth nozzles N12. Each of the plurality of twelfth nozzles N12 discharges the yellow ink Y.

In the following description, the fifth head H5 and the sixth head H6 may be omitted for simplification of description. For example, in FIGS. 11 and 12 described later, the fifth head H5 and the sixth head H6 are omitted, and only the first head H1 and the second head H2 are illustrated.

The nozzle row Lia and the nozzle row Lib are positioned across the first part U1 and the second part U2. The nozzle row L2*a* and the nozzle row L2*b* are positioned across the first part U1 and the third part U3. The nozzle row L5*a*, the nozzle row L5*b*, the nozzle row L6*a*, and the nozzle row L6*b* are positioned in the first part U1. The nozzle row Lia, the nozzle row Lib, the nozzle row L5*a*, and the nozzle row L5*b* are positioned in the X2 direction with respect to the center line Lc. The nozzle row L2*a*, the nozzle row L2*b*, the nozzle row L6*a*, and the nozzle row L6*b* are positioned in the X1 direction with respect to the center line Lc. A part of the nozzle row Lia and a part of the nozzle row L6*a* overlap with each other in the Y axis. A part of the nozzle row L6*a* and a part of the nozzle row L5*a* overlap with each other in the Y axis. A part of the nozzle row L5*a* and a part of the nozzle row L2*a* overlap with each other in the Y axis. A part of the nozzle row Lib and a part of the nozzle row L6*b* overlap with each other in the Y axis. A part of the nozzle row L6*b* and a part of the nozzle row L5*b* overlap with each other in the Y axis. A part of the nozzle row L5*b* and a part of the nozzle row L2*b* overlap with each other in the Y axis.

Further, the position of the nozzle row Lia in the X1 direction is different from both the position of the nozzle row L2*a* in the X1 direction and the position of the nozzle row L2*b* in the X1 direction. The position of the nozzle row L1*a* in the Y1 direction is different from both the position of the nozzle row L2*a* in the Y1 direction and the position of the nozzle row L2*b* in the Y1 direction. The position of the nozzle row L1*b* in the X1 direction is different from both the position of the nozzle row L2*a* in the X1 direction and the position of the nozzle row L2*b* in the X1 direction. The position of the nozzle row L1*b* in the Y1 direction is different from both the position of the nozzle row L2*a* in the Y1 direction and the position of the nozzle row L2*b* in the Y1 direction.

When it is not necessary to distinguish the nozzle row L1*a*, the nozzle row L2*a*, the nozzle row L5*a*, and the nozzle row L6*a* from each other, these are referred to as "nozzle row Lna". When it is not necessary to distinguish the nozzle row L1*b*, the nozzle row L2*b*, the nozzle row L5*b*, and the nozzle row L6*b* from each other, these are referred to as "nozzle row Lnb".

1-4. Second Head Unit 252_2

Figure 6:
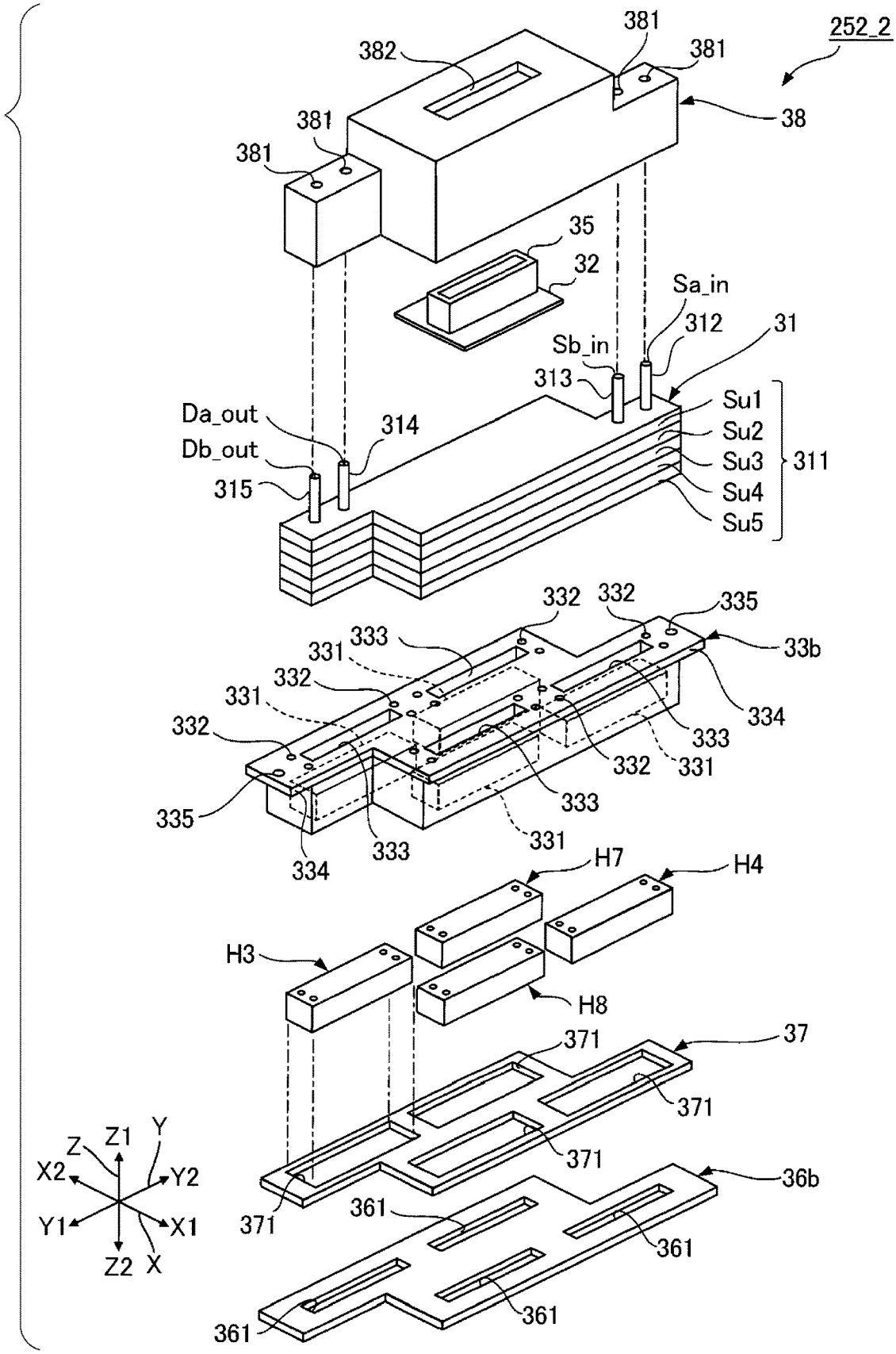
FIG. 6 is a disassembled perspective view of a second head unit.

FIG. 6 is a disassembled perspective view of the second head unit 252_2. In FIG. 6, elements having the same configurations as those illustrated in FIG. 3 are designated by the same reference numerals. The differences between the second head unit 252_2 and the first head unit 252_1 will be mainly described below.

The second head unit 252_2 differs from the first head unit 252_1 in the following points.

The second head unit 252_2 has a third head H3, a fourth head H4, a seventh head H7, and an eighth head H8 instead of the first head H1, the second head H2, the fifth head H5, and the sixth head H6. The third head H3, the fourth head H4, the seventh head H7, and the eighth head H8 have the same configuration. When it is not necessary to distinguish the third head H3, the fourth head H4, the seventh head H7, and the eighth head H8 from each other, these are referred to as "head Hm". Each head Hm has a plurality of nozzles that discharge the magenta ink M and a plurality of nozzles that discharge the black ink K.

Although not illustrated in FIG. 6, the flow path structure 311 of the second head unit 252_2 is provided with a supply flow path for supplying the magenta ink M to the plurality of heads Hm, a supply flow path for supplying the black ink K to the plurality of heads Hm, an exhaust flow path for exhausting the magenta ink M from the plurality of heads Hm, and an exhaust flow path for exhausting the black ink K from the plurality of heads Hm.

Further, in the second head unit 252_2, the supply port Sa_in is used for supplying the magenta ink M to the flow path structure 311, the supply port Sb_in is used for supplying the black ink K to the flow path structure 311, the exhaust port Da_out is used for exhausting the magenta ink M from the flow path structure 311, and the exhaust port Db_out is used for exhausting the black ink K from the flow path structure 311.

In the second head unit 252_2, the second holder 33*b* is used instead of the first holder 33*a*, and the second fixing plate 36*b* is used instead of the first fixing plate 36*a*. The second holder 33*b* has the same configuration as the first holder 33*a*. The second fixing plate 36*b* has the same configuration as the first fixing plate 36*a*.

Figure 7:
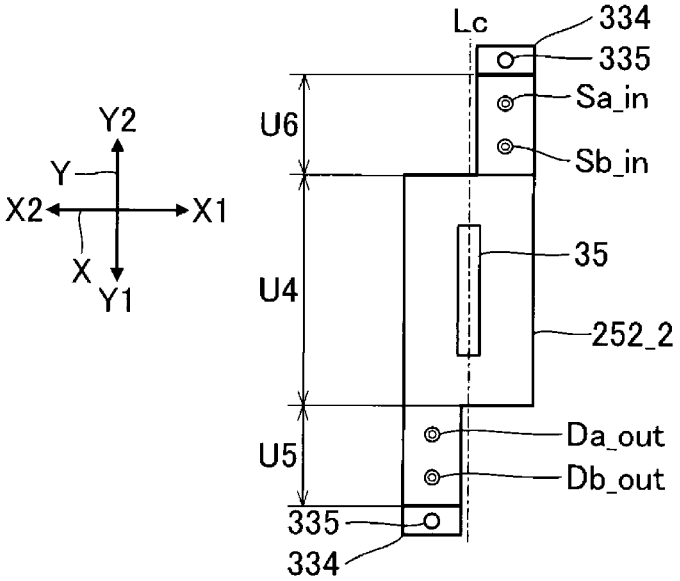
FIG. 7 is a plan view of the second head unit as viewed from a Z1 direction.

FIG. 7 is a plan view of the second head unit 252_2 as viewed from the Z1 direction. The second head unit 252_2 has a fourth part U4, a fifth part U5, and a sixth part U6. Each of the fourth part U4, the fifth part U5, and the sixth part U6 has a quadrangular shape in which the longitudinal direction is the Y1 direction when viewed from the Z1 direction. The mutual relationship among the fourth part U4, the fifth part U5 and the sixth part U6 is the same as the mutual relationship between the first part U1, the second part U2, and the third part U3.

Figure 8:
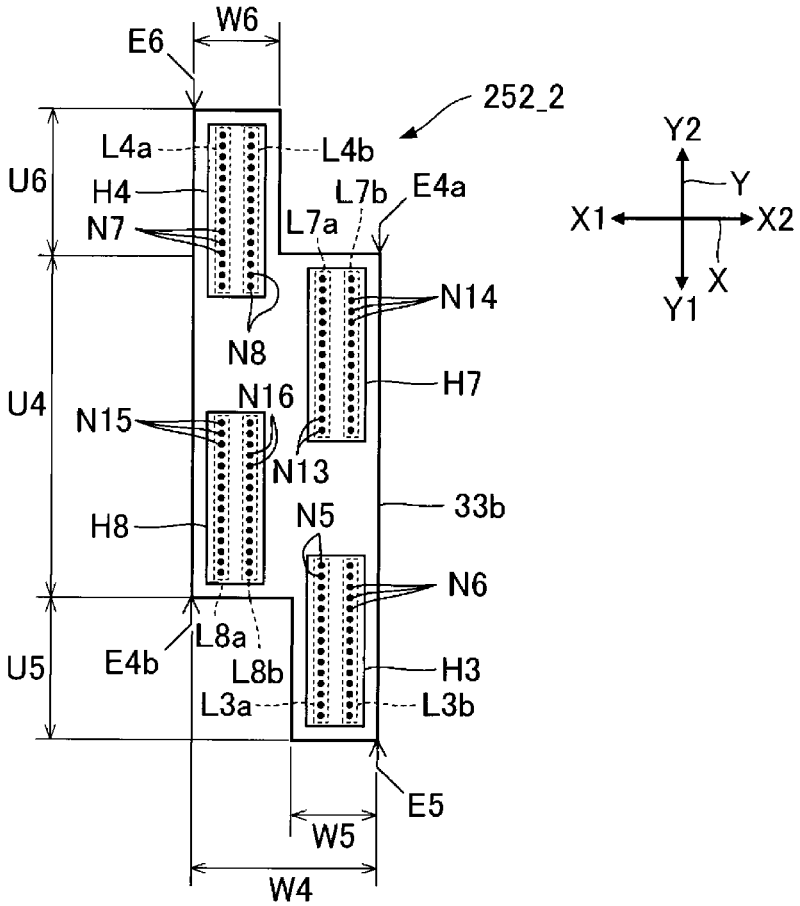
FIG. 8 is a plan view of the second head unit as viewed from a Z2 direction.

FIG. 8 is a plan view of the second head unit 252_2 as viewed from the Z2 direction. In FIG. 8, the flange 334, the second fixing plate 36*b*, and the reinforcing plate 37 are omitted for convenience of description. The third head H3 is disposed across the fourth part U4 and the fifth part U5. The fourth head H4 is disposed across the fourth part U4 and the sixth part U6. The seventh head H7 and the eighth head H8 are disposed in the fourth part U4. The third head H3 and the seventh head H7 are positioned in the X2 direction with respect to the center line Lc. The fourth head H4 and the eighth head H8 are positioned in the X1 direction with respect to the center line Lc. A part of the third head H3 and a part of the eighth head H8 overlap with each other in the Y axis. A part of the eighth head H8 and a part of the seventh head H7 overlap with each other in the Y axis. A part of the seventh head H7 and a part of the fourth head H4 overlap with each other in the Y axis.

The position of the third head H3 in the X1 direction is different from the position of the fourth head H4 in the X1 direction. The position of the third head H3 in the Y1 direction is different from the position of the fourth head H4 in the Y1 direction.

The position of the third head H3 in the X1 direction is the same as the position of the seventh head H7 in the X1 direction. The position of the third head H3 in the Y1 direction is different from the position of the seventh head H7 in the Y1 direction.

The position of the third head H3 in the X1 direction is different from the position of the eighth head H8 in the X1 direction. The position of the third head H3 in the Y1 direction is different from the position of the eighth head H8 in the Y1 direction.

The position of the fourth head H4 in the X1 direction is different from the position of the seventh head H7 in the X1 direction. The position of the fourth head H4 in the Y1 direction is different from the position of the seventh head H7 in the Y1 direction.

The position of the fourth head H4 in the X1 direction is the same as the position of the eighth head H8 in the X1 direction. The position of the fourth head H4 in the Y1 direction is different from the position of the eighth head H8 in the Y1 direction.

The width W4 of the fourth part U4 along the X axis is the same as the width W1 of the first part U1 along the X axis. The width W5 of the fifth part U5 along the X axis is the same as the width W2 of the second part U2 along the X axis. The width W6 of the sixth part U6 along the X axis is the same as the width W2 of the third part U3 along the X axis. The width W4 may be different from the width W1, the width W5 may be different from the width W2, and the width W6 may be different from the width W2. The widths W4, W5, and W6 of the fourth part U4, the fifth part U5, and the sixth part U6 are the widths between one end portion and the other end portion along the X axis of each part.

An end surface E4*a* of the fourth part U4 in the X2 direction is a plane continuous with an end surface E5 of the fifth part U5 in the X2 direction. An end surface E4*b* of the fourth part U4 in the X1 direction is a plane continuous with an end surface E6 of the sixth part U6 in the X1 direction. A recess portion or a projection portion may be appropriately provided on these end surfaces. Further, a step may be provided between the end surface E4*a* and the end surface E5, and a step may be provided between the end surface E4*b* and the end surface E6.

The third head H3 is provided with a nozzle row L3*a* and a nozzle row L3*b*. Each of the nozzle row L3*a* and the nozzle row L3*b* is a set of the plurality of nozzles N arranged along the Y axis. The nozzle row L3*a* and the nozzle row L3*b* are provided side by side with an interval in between in the direction of the X axis. The nozzle row L3*a* is constituted by a plurality of fifth nozzles N5. Each of the plurality of fifth nozzles N5 discharges the magenta ink M. The nozzle row L3*b* is constituted by a plurality of sixth nozzles N6. Each of the plurality of sixth nozzles N6 discharges the black ink K.

The fourth head H4 is provided with a nozzle row L4*a* and a nozzle row L4*b*. Each of the nozzle row L4*a* and the nozzle row L4*b* is a set of the plurality of nozzles N arranged along the Y axis. The nozzle row L4*a* and the nozzle row L4*b* are provided side by side with an interval in between in the direction of the X axis. The nozzle row L4*a* is constituted by a plurality of seventh nozzles N7. Each of the plurality of seventh nozzles N7 discharges the magenta ink M. The nozzle row L4*b* is constituted by a plurality of eighth nozzles N8. Each of the plurality of eighth nozzles N8 discharges the black ink K.

The seventh head H7 is provided with a nozzle row L7*a* and a nozzle row L7*b*. Each of the nozzle row L7*a* and the nozzle row L7*b* is a set of the plurality of nozzles N arranged along the Y axis. The nozzle row L7*a* and the nozzle row L7*b* are provided side by side with an interval in between in the direction of the X axis. The nozzle row L7*a* is constituted by a plurality of thirteenth nozzles N13. Each of the plurality of thirteenth nozzles N13 discharges the magenta ink M. The nozzle row L7*b* is constituted by a plurality of fourteenth nozzles N14. Each of the plurality of fourteenth nozzles N14 discharges the black ink K.

The eighth head H8 is provided with a nozzle row L8*a* and a nozzle row L8*b*. Each of the nozzle row L8*a* and the nozzle row L8*b* is a set of the plurality of nozzles N arranged along the Y axis. The nozzle row L8*a* and the nozzle row L8*b* are provided side by side with an interval in between in the direction of the X axis. The nozzle row L8*a* is constituted by a plurality of fifteenth nozzles N15. Each of the plurality of fifteenth nozzles N15 discharges the magenta ink M. The nozzle row L8*b* is constituted by a plurality of sixteenth nozzles N16. Each of the plurality of sixteenth nozzles N16 discharges the black ink K.

The nozzle row L3*a* and the nozzle row L3*b* are positioned across the fourth part U4 and the fifth part U5. The nozzle row L4*a* and the nozzle row L4*b* are positioned across the fourth part U4 and the sixth part U6. The nozzle row L7*a*, the nozzle row L7*b*, the nozzle row L8*a*, and the nozzle row L8*b* are positioned in the fourth part U4. The nozzle row L3*a*, the nozzle row L3*b*, the nozzle row L7*a*, and the nozzle row L7*b* are positioned in the X2 direction with respect to the center line Lc. The nozzle row L4*a*, the nozzle row L4*b*, the nozzle row L8*a*, and the nozzle row L8*b* are positioned in the X1 direction with respect to the center line Lc. A part of the nozzle row L3*a* and a part of the nozzle row L8*a* overlap with each other in the Y axis. A part of the nozzle row L8*a* and part of the nozzle row L7*a* overlap with each other in the Y axis. A part of the nozzle row L7*a* and part of the nozzle row L4*a* overlap with each other in the Y axis. A part of the nozzle row L3*b* and part of the nozzle row L8*b* overlap with each other in the Y axis. A part of the nozzle row L8*b* and part of the nozzle row L7*b* overlap with each other in the Y axis. A part of the nozzle row L7*b* and part of the nozzle row L4*b* overlap with each other in the Y axis.

Further, the position of the nozzle row L3*a* in the X1 direction is different from both the position of the nozzle row L4*a* in the X1 direction and the position of the nozzle row L4*b* in the X1 direction. The position of the nozzle row L3*a* in the Y1 direction is different from both the position of the nozzle row L4*a* in the Y1 direction and the position of the nozzle row L4*b* in the Y1 direction.

The position of the nozzle row L3*b* in the X1 direction is different from both the position of the nozzle row L4*a* in the X1 direction and the position of the nozzle row L4*b* in the X1 direction. The position of the nozzle row L3*b* in the Y1 direction is different from both the position of the nozzle row L4*a* in the Y1 direction and the position of the nozzle row L4*b* in the Y1 direction.

When it is not necessary to distinguish the nozzle row L3*a*, the nozzle row L4*a*, the nozzle row L7*a*, and the nozzle row L8*a* from each other, these are referred to as "nozzle row Lma". When it is not necessary to distinguish the nozzle row L3*b*, the nozzle row L4*b*, the nozzle row L7*b*, and the nozzle row L8*b* from each other, these are referred to as "nozzle row Lmb".

1-5. Head Hn

Figure 9:
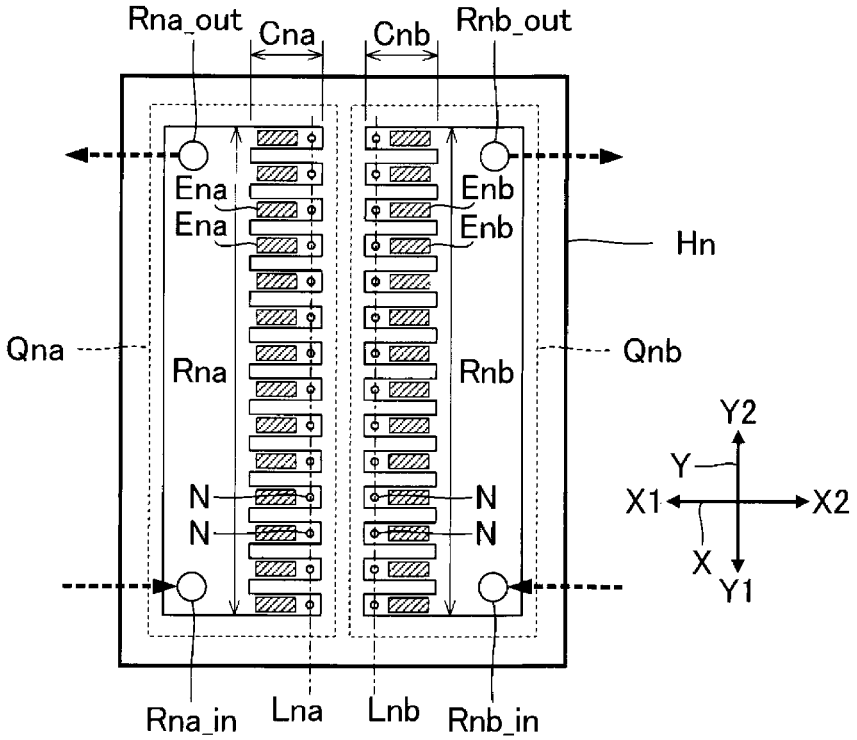
FIG. 9 is a plan view of a head Hn.

FIG. 9 is a plan view of a head Hn. FIG. 9 schematically illustrates the internal structure of the head Hn viewed from the Z2 direction. The head Hn includes a liquid discharging portion Qna and a liquid discharging portion Qnb. The liquid discharging portion Qna discharges the cyan ink C supplied from a first sub tank 13*a* from each nozzle N of the nozzle row Lna. The liquid discharging portion Qnb discharges the yellow ink Y supplied from a third sub tank 13*c* from each nozzle N of the nozzle row Lnb.

The liquid discharging portion Qna includes a liquid storage chamber Rna, a plurality of pressure chambers Cna, and a plurality of driving elements Ena. The liquid storage chamber Rna is a common liquid chamber that is continuous over the plurality of nozzles N of the nozzle row Lna. The pressure chamber Cna and the driving element Ena are formed for each nozzle N of the nozzle row Lna. The pressure chamber Cna is a space for communicating with the nozzle N. Each of the plurality of pressure chambers Cna is filled with the cyan ink C supplied from the liquid storage chamber Rna. The driving element Ena changes the pressure of the cyan ink C inside the pressure chamber Cna. For example, a piezoelectric element that changes the volume of the pressure chamber Cna by deforming the wall surface of the pressure chamber Cna or a heat generating element that generates bubbles inside the pressure chamber Cna by heating the cyan ink C inside the pressure chamber Cna is desirably utilized as the driving element Ena. The driving element Ena changes the pressure of the cyan ink C in the pressure chamber Cna, and thus the cyan ink C inside the pressure chamber Cna is discharged from the nozzle N.

The liquid discharging portion Qnb includes a liquid storage chamber Rnb, a plurality of pressure chambers Cnb, and a plurality of driving elements Enb. The liquid storage chamber Rnb is a common liquid chamber that is continuous over the plurality of nozzles N of the nozzle row Lnb. The pressure chamber Cnb is a space for communicating with the nozzle N. The pressure chamber Cnb and the driving element Enb are formed for each nozzle N of the nozzle row Lnb. Each of the plurality of pressure chambers Cnb is filled with the yellow ink Y supplied from the liquid storage chamber Rnb. The driving element Enb is, for example, the above-described piezoelectric element or heat generating element. The driving element Enb changes the pressure of the yellow ink Y in the pressure chamber Cnb, and thus the yellow ink Y inside the pressure chamber Cnb is discharged from the nozzle N.

The head Hn is provided with a supply port Rna_in, an exhaust port Rna_out, a supply port Rnb_in, and an exhaust port Rnb_out. The supply port Rna_in and the exhaust port Rna_out communicate with the liquid storage chamber Rna. The supply port Rnb_in and the exhaust port Rnb_out communicate with the liquid storage chamber Rnb.

The cyan ink C, among the cyan ink C stored in the liquid storage chamber Rna, that is not discharged from each nozzle N of the nozzle row Lna circulates in the path of the exhaust port Rna_out→the exhaust flow path for the cyan ink C of the flow path member 31→the first sub tank 13*a* provided outside the head unit 252→the supply flow path for the cyan ink C of the flow path member 31→the supply port Rna_in→the liquid storage chamber Rna.

The yellow ink Y, among the yellow ink Y stored in the liquid storage chamber Rnb, that is not discharged from each nozzle N of the nozzle row Lnb circulates in the path of the exhaust port Rnb_out→the exhaust flow path for the yellow ink Y of the flow path member 31→the third sub tank 13*c* provided outside the head unit 252→the supply flow path for the yellow ink Y of the flow path member 31→the supply port Rnb_in→the liquid storage chamber Rnb.

Although not illustrated, the head Hn is constituted by laminating a plurality of substrates such as a nozzle substrate, a reservoir substrate, a pressure chamber substrate, and an element substrate. For example, the nozzle rows Lna and Lnb are provided on a nozzle substrate. The liquid storage chambers Rna and Rnb are provided on a reservoir substrate. The pressure chambers Cna and Cnb are provided on the pressure chamber substrate. The driving elements Ena and Enb are provided on the element substrate.

1-6. Head Hm

Figure 10:
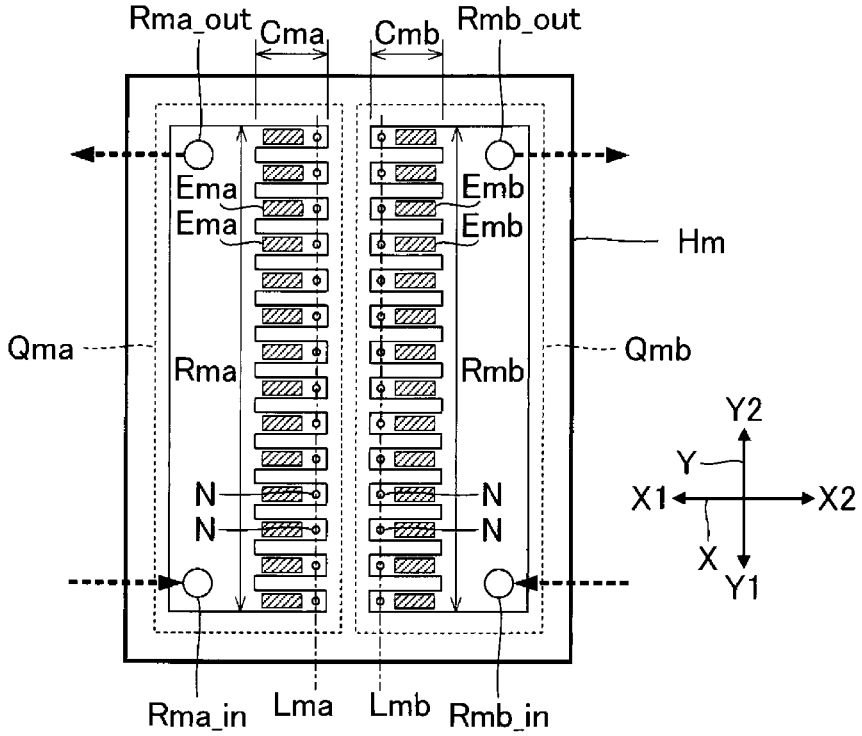
FIG. 10 is a plan view of a head Hm.

FIG. 10 is a plan view of a head Hm. FIG. 10 schematically illustrates the internal structure of the head Hm viewed from the Z2 direction. The head Hm includes a liquid discharging portion Qma and a liquid discharging portion Qmb. The liquid discharging portion Qma discharges the magenta ink M supplied from a second sub tank 13*b* from each nozzle N of the nozzle row Lma. The liquid discharging portion Qmb discharges the black ink K supplied from a fourth sub tank 13*d* from each nozzle N of the nozzle row Lmb.

The liquid discharging portion Qma includes a liquid storage chamber Rma, a plurality of pressure chambers Cma, and a plurality of driving elements Ema. The liquid storage chamber Rma is a common liquid chamber that is continuous over the plurality of nozzles N of the nozzle row Lma. The pressure chamber Cma and the driving element Ema are formed for each nozzle N of the nozzle row Lma. The pressure chamber Cma is a space for communicating with the nozzle N. Each of the plurality of pressure chambers Cma is filled with the magenta ink M supplied from the liquid storage chamber Rma. The driving element Ema is, for example, the above-described piezoelectric element or heat generating element. The driving element Ema changes the pressure of the magenta ink M in the pressure chamber Cma, and thus the magenta ink M inside the pressure chamber Cma is discharged from the nozzle N.

The liquid discharging portion Qmb includes a liquid storage chamber Rmb, a plurality of pressure chambers Cmb, and a plurality of driving elements Emb. The liquid storage chamber Rmb is a common liquid chamber that is continuous over the plurality of nozzles N of the nozzle row Lmb. The pressure chamber Cmb and the driving element Emb are formed for each nozzle N of the nozzle row Lmb. The pressure chamber Cmb is a space for communicating with the nozzle N. Each of the plurality of pressure chambers Cmb is filled with the black ink K supplied from the liquid storage chamber Rmb. The driving element Emb is, for example, the above-described piezoelectric element or heat generating element. The driving element Emb changes the pressure of the black ink K in the pressure chamber Cmb, and thus the black ink K inside the pressure chamber Cmb is discharged from the nozzle N.

The head Hm is provided with a supply port Rma_in, an exhaust port Rma_out, a supply port Rmb_in, and an exhaust port Rmb_out. The supply port Rma_in and the exhaust port Rma_out communicate with the liquid storage chamber Rma. The supply port Rmb_in and the exhaust port Rmb_out communicate with the liquid storage chamber Rmb.

The magenta ink M, among the magenta ink M stored in the liquid storage chamber Rma, that is not discharged from each nozzle N of the nozzle row Lma circulates in the path of the exhaust port Rma_out→the exhaust flow path for the magenta ink M of the flow path member 31→the second sub tank 13*b* provided outside the head unit 252→the supply flow path for the magenta ink M of the flow path member 31→the supply port Rma_in→the liquid storage chamber Rma.

The black ink K, among the black ink K stored in the liquid storage chamber Rmb, that is not discharged from each nozzle N of the nozzle row Lmb circulates in the path of the exhaust port Rmb_out→the exhaust flow path for the black ink K of the flow path member 31→the fourth sub tank 13*d* provided outside the head unit 252→the supply flow path for the black ink K of the flow path member 31→the supply port Rmb_in→the liquid storage chamber Rmb.

Although not illustrated, the head Hm is constituted by laminating a plurality of substrates such as a nozzle substrate, a reservoir substrate, a pressure chamber substrate, and an element substrate. For example, the nozzle rows Lma and Lmb are provided on a nozzle substrate. The liquid storage chambers Rma and Rmb are provided on a reservoir substrate. The pressure chambers Cma and Cmb are provided on the pressure chamber substrate. The driving elements Ema and Emb are provided on the element substrate.

1-7. Positional Shifting of Head Unit

There is a possibility that each head unit 252 is mounted at a position different from the designed mounting position due to a mounting error or the like. For example, when the position of the screw hole 254 illustrated in FIG. 2 or the hole 335 illustrated in FIG. 3 is shifted from the designed position, the first head unit 252_1 is mounted at a position different from the designed mounting position. Further, when the head unit 252 is mounted on the support body 251, and used, the looseness occurs in at least one of the screw hole 254 and the hole 335 with the passage of time, and thus the head unit 252 may be gradually shifted to a different position. Hereinafter, a state in which the position of the head unit 252 is shifted from the designed mounting position is referred to as "positional shifting". The positional shifting occurs individually in each head unit 252. For example, of the first head unit 252_1 and the second head unit 252_2, the positional shifting occurs only in the first head unit 252_1.

The positional shifting caused by rotating the regular position by a predetermined angle is particularly likely to occur. It is considered that this is because in the first head unit 252_1, the width of the second part U2 and the third part U3 in the direction along the X axis is smaller than the width of the first part U1 in the direction along the X axis.

First, when a force is applied to one of the second part U2 and the third part U3 of the first head unit 252_1 in either direction along the X axis, the force is applied to the other in the opposite direction. For example, when a force is added to the second part U2 of the first head unit 252_1 toward the X1 side, a reaction force acts on the third part U3 toward the X2 side. Therefore, the first head unit 252_1 tries to rotate clockwise.

In a head unit that linearly extends along the Y axis, which will be described later with reference to FIG. 16 and the like, even when the head unit is rotated in the clockwise direction, the head unit contacts a head unit disposed adjacent to the X axis, and therefore, a large rotation does not occur. However, in the first head unit 252_1 of the present embodiment, the end portion of the third part U3 in the X2 direction is positioned more on the X1 side than the end portion of the first part U1 in the X2 direction. That is, the interval between the end portion of the third part U3 of the first head unit 252_1 in the X2 side and the end portion of the third part U3 of the second head unit 252_2 in the X2 side, in the direction along the X axis is larger than the interval between the head units that linearly extend along the Y axis, in both directions on the X axis. Therefore, the first head unit 252_1 becomes easy to rotate.

Figure 11:
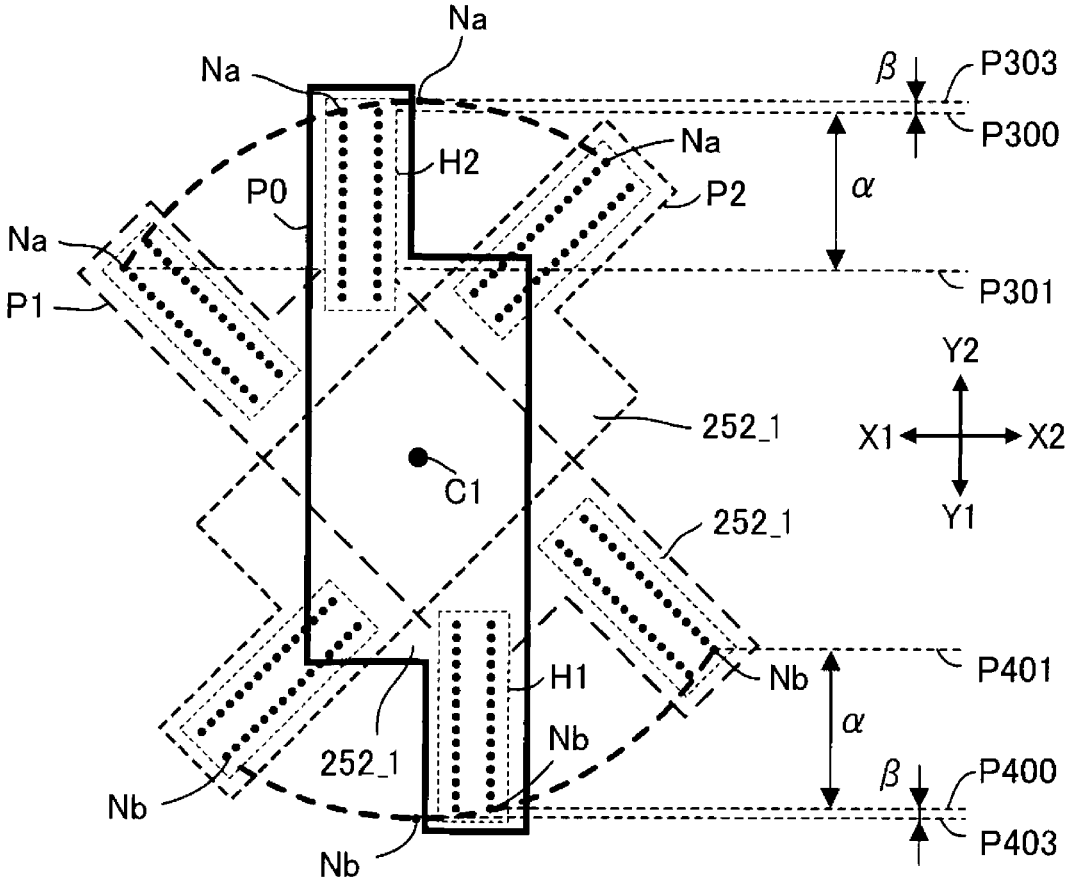
FIG. 11 is a diagram illustrating an example of a positional shifting in the first head unit.

FIG. 11 is a diagram illustrating an example of a positional shifting in the first head unit 252_1. Hereinafter, the right rotation that is the clockwise rotation will be referred to as a positive rotation, and the left rotation or the counterclockwise rotation will be referred to as a negative rotation.

In FIG. 11, the first head unit 252_1 which is positioned at the designed mounting position P0, the first head unit 252_1 which is positioned at the shifted position P1, and the first head unit 252_1 which is positioned at the shifted position P2 are illustrated. The shifted position P1 is a position where the first head unit 252_1 positioned at the designed mounting position P0 is rotated by −45 degrees on the XY plane with the center C1 of the first head unit 252_1 as a rotation center. The center C1 of the first head unit 252_1 means the geometric center of gravity in the first head unit 252_1. The shifted position P2 is a position where the first head unit 252_1 positioned at the designed mounting position P0 is rotated by +45 degrees on the XY plane with the center C1 as a rotation center. Although not illustrated in FIG. 11 in order to avoid complication, the position where the first head unit 252_1 positioned at the designed mounting position P0 is rotated by +12.5 degrees on the XY plane with the center C1 as the center of rotation is referred to as a shifted position P3. The shifted position P3 is a position where the first reference nozzle Na provided in the fourth head H4 is most shifted in the Y2 direction. The rotation angle for defining the shifted position is not limited to −45 degrees, +45 degrees, and +12.5 degrees. Further, the center of rotation for defining the shifted position is not limited to the center of the head unit 252. The first reference nozzle Na may be any of the plurality of nozzles N provided in the fourth head H4, and is not limited to the nozzle N illustrated in FIG. 11.

FIG. 11 illustrates the second reference nozzle Nb provided in the first head H1. The second reference nozzle Nb may be any of the plurality of nozzles N provided in the first head H1, and is not limited to the nozzle N illustrated in FIG. 11.

The position P301 of the first reference nozzle Na in the Y1 direction in the situation in which the first head unit 252_1 is positioned at the shifted position P1 is shifted by the distance α in the Y1 direction than the position P300 of the first reference nozzle Na in the Y1 direction in the situation in which the first head unit 252_1 is positioned at the designed mounting position P0. The position P303 of the first reference nozzle Na in the Y1 direction in the situation in which the first head unit 252_1 is positioned at the shifted position P3 is shifted by a distance β in the Y2 direction than the position P300.

The position P401 of the second reference nozzle Nb in the Y1 direction in the situation in which the first head unit 252_1 is positioned at the shifted position P1 is shifted by the distance α in the Y2 direction than the position P400 of the second reference nozzle Nb in the Y1 direction in the situation in which the first head unit 252_1 is positioned at the designed mounting position P0. The position P403 of the second reference nozzle Nb in the Y1 direction in the situation in which the first head unit 252_1 is positioned at the shifted position P3 is shifted by the distance β in the Y1 direction than the position P400.

Figure 12:
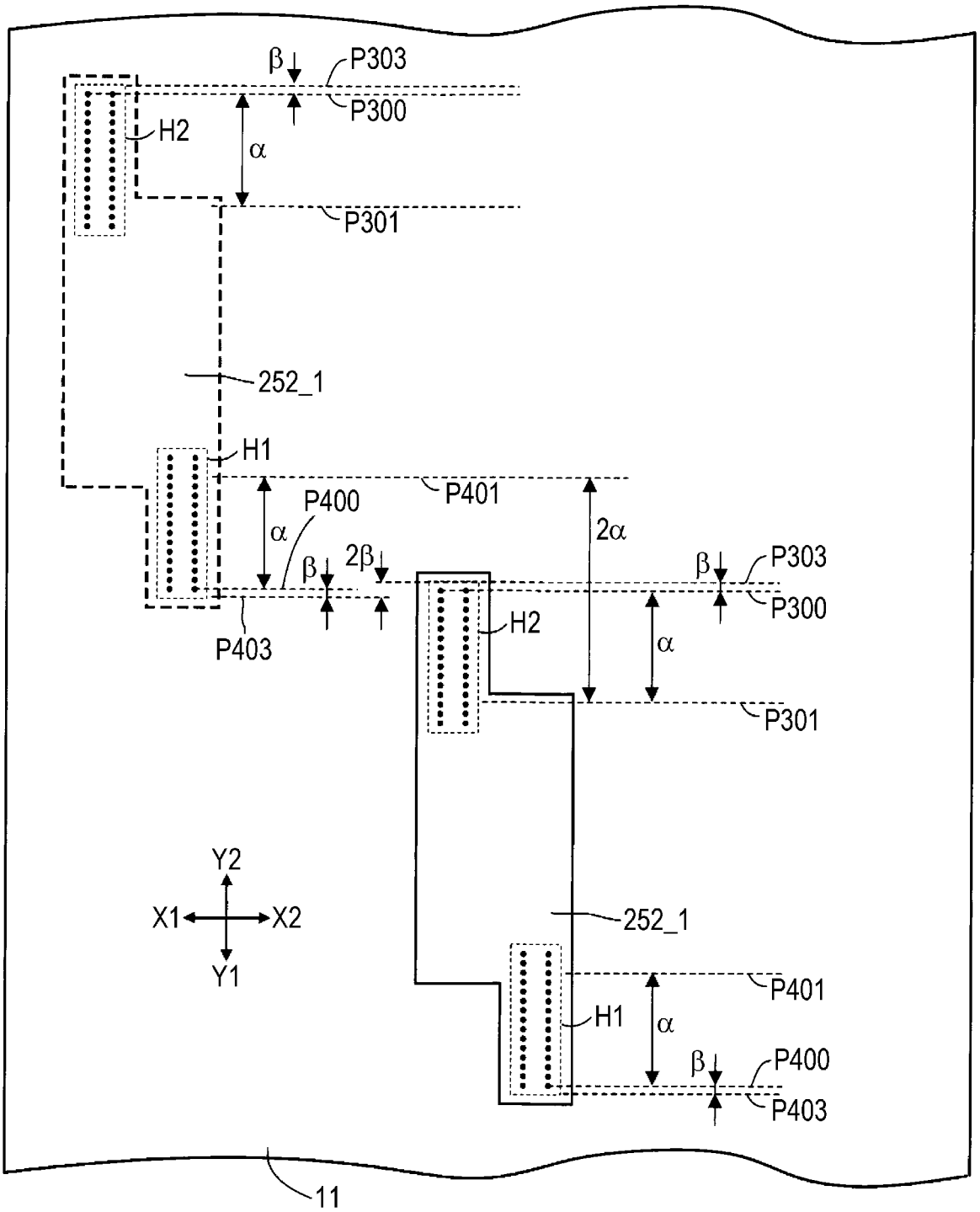
FIG. 12 is a diagram illustrating a relative positional relationship between a medium and the first head unit.

FIG. 12 is a diagram illustrating a situation where ink is discharged from the first head unit 252_1 while reciprocating the first head unit 252_1 along the X axis, and the medium 11 is transported along the Y axis by the relative positional relationship between the medium 11 and the first head unit 252_1.

Hereinafter, the movement of the first head unit 252_1 in the X2 direction indicated by the broken line in FIG. 12 is referred to as "a first pass", and the movement of the first head unit 252_1 in the X1 direction indicated by the solid line in FIG. 12 is referred to as "a second pass". The movement direction of the first pass may be the X1 direction. The movement direction of the second pass may be the X2 direction. In FIG. 12, the position P400 in the first head unit 252_1 indicated by the broken line coincides with the position P300 in the first head unit 252_1 indicated by the solid line.

Figure 13:
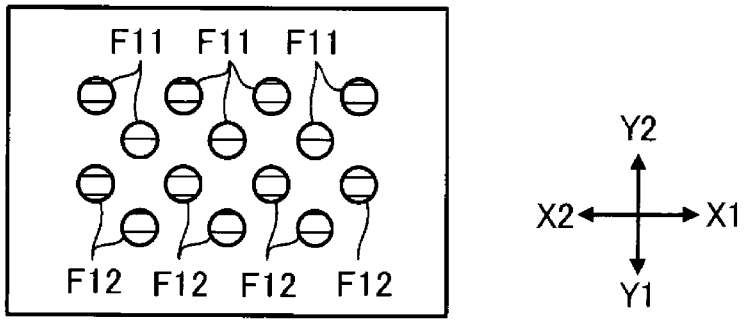
FIG. 13 is a diagram illustrating ink dots in a situation where there is no positional shifting.

FIG. 13 is a diagram illustrating dots F11 formed by the ink discharged during the first pass and dots F12 formed by the ink discharged during the second pass in a situation where there is no positional shifting in the first head unit 252_1.

When there is no positional shifting in the first head unit 252_1, the positional relationship between the dots F11 and F12 is a designed positional relationship.

Figure 14:
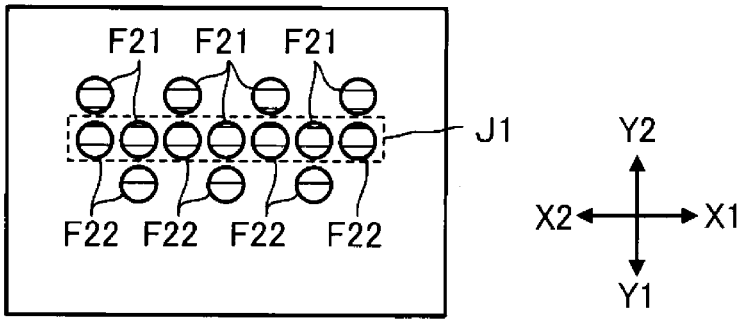
FIG. 14 is a diagram illustrating an example of ink dots in a situation where there is a positional shifting.

FIG. 14 is a diagram illustrating dots F21 formed by the ink discharged during the first pass and dots F22 formed by the ink discharged during the second pass in a situation where the position of the first reference nozzle Na is shifted in the Y2 direction due to the positional shifting of the first head unit 252_1 and the second reference nozzle Nb is shifted in the Y1 direction.

When the position of the first reference nozzle Na is shifted in the Y2 direction and the second reference nozzle Nb is shifted in the Y1 direction, there may be a region where the dots F21 and F22 overlap each other in the Y1 direction. Hereinafter, the region where the dots overlap each other in the Y1 direction due to the positional shifting will be referred to as "a black stripe J1". When the black stripe J1 is generated, the quality of the image formed by the dots F21 and F22 deteriorates.

Figure 15:
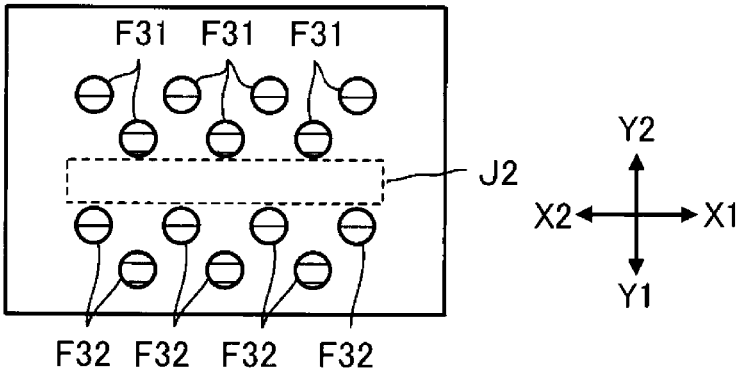
FIG. 15 is a diagram illustrating another example of ink dots in a situation where there is a positional shifting.

FIG. 15 is a diagram illustrating dots F31 formed by the ink discharged during the first pass and dots F32 formed by the ink discharged during the second pass in a situation where the position of the first reference nozzle Na is shifted in the Y1 direction due to the positional shifting of the first head unit 252_1 and the second reference nozzle Nb is shifted in the Y2 direction.

When the position of the first reference nozzle Na is shifted in the Y1 direction and the second reference nozzle Nb is shifted in the Y2 direction, there may be a region where the dots F31 and F32 overlap each other in the Y1 direction. Hereinafter, the region where the dots do not present in the Y1 direction due to the positional shifting will be referred to as "a white stripe J2". When the white stripe J2 is generated, the quality of the image formed by the dots F31 and F32 deteriorates.

Figure 16:
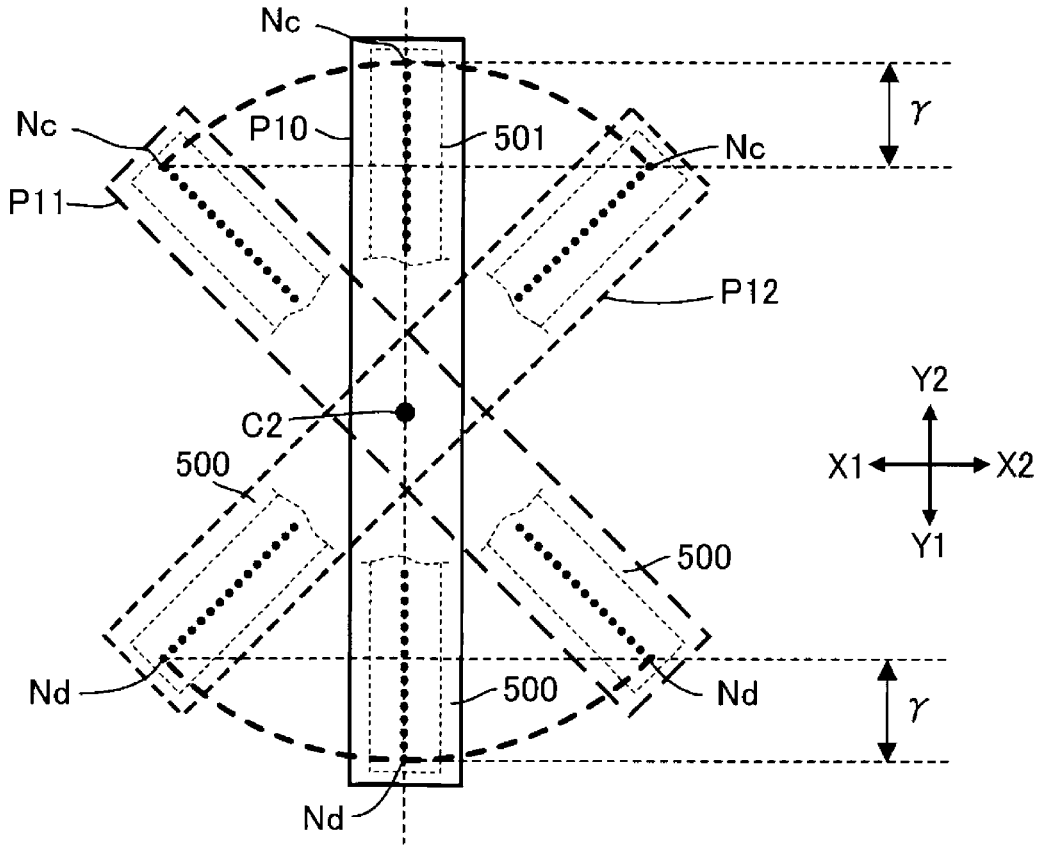
FIG. 16 is a diagram illustrating an example of a positional shifting in a comparative head unit.

FIG. 16 is a diagram illustrating an example of positional shifting in the comparative head unit 500 having a head 501 in which the nozzles are provided along a straight line.

In FIG. 16, the comparative head unit 500 which is positioned at the designed mounting position P10, the comparative head unit 500 which is positioned at the shifted position P11, and the comparative head unit 500 which is positioned at the shifted position P12 are illustrated. The shifted position P11 is a position where the comparative head unit 500 positioned at the designed mounting position P10 is rotated by −45 degrees on the XY plane with the center C2 of the comparative head unit 500 as a rotation center. The center C2 of the comparative head unit 500 means the geometric center of gravity in the comparative head unit 500. The shifted position P12 is a position where the comparative head unit 500 positioned at the designed mounting position P10 is rotated by +45 degrees on the XY plane with the center C2 as a rotation center.

As illustrated in FIG. 16, in the comparative head unit 500, the position of the third reference nozzle Nc, which is positioned in Y2 direction from the center C2, in the Y1 direction is shifted in the Y1 direction regardless of the rotational direction of the shifting in the comparative head unit 500. In the example illustrated in FIG. 16, the position of the third reference nozzle Nc in the Y1 direction is shifted by a distance γ in the Y1 direction according to the positional shifting of the comparative head unit 500.

Further, in the comparative head unit 500, the position of the fourth reference nozzle Nd, which is positioned in Y1 direction from the center C2, in the Y1 direction is shifted in the Y2 direction regardless of the rotational direction of the shifting in the comparative head unit 500. In the example illustrated in FIG. 16, the position of the fourth reference nozzle Nd in the Y1 direction is shifted by the distance γ in the Y2 direction according to the positional shifting of the comparative head unit 500.

Figure 17:
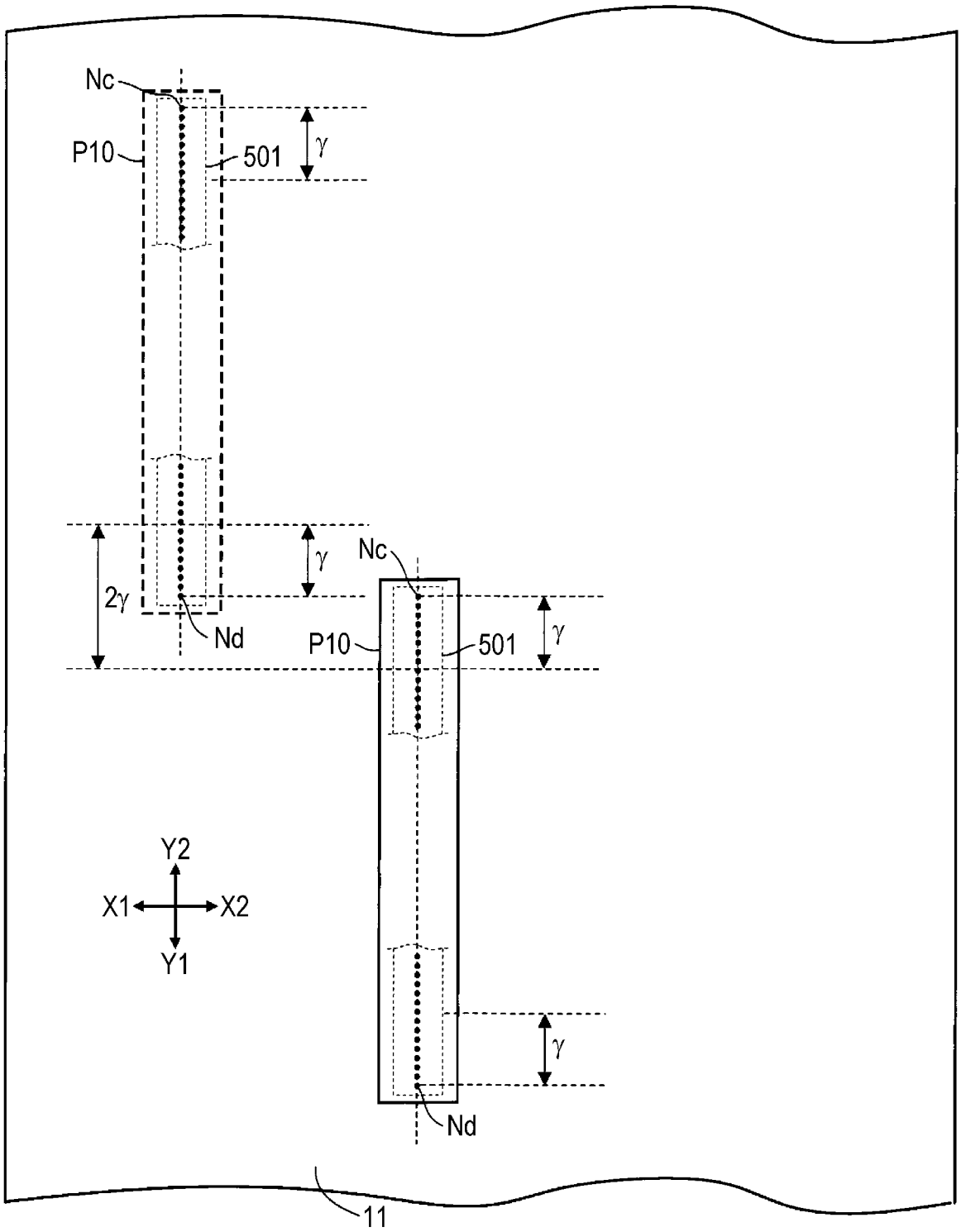
FIG. 17 is a diagram illustrating a relative positional relationship between a medium and the first head unit.

FIG. 17 is a diagram illustrating a situation where ink is discharged from the comparative head unit 500 while reciprocating the comparative head unit 500 along the X axis, and the medium 11 is transported along the Y axis by the relative positional relationship between the medium 11 and the comparative head unit 500. Hereinafter, the movement of the comparative head unit 500 in the X2 direction indicated by the broken line in FIG. 17 is referred to as "a third pass", and the movement of the comparative head unit 500 in the X1 direction indicated by the solid line in FIG. 17 is referred to as "a fourth pass". The movement direction of the third pass may be the X1 direction. The movement direction of the fourth pass may be the X2 direction.

In FIG. 17, the position of the fourth reference nozzle Nd in the Y1 direction in the comparative head unit 500 indicated by the broken line coincides with the position of the third reference nozzle Nc in the Y1 direction in the comparative head unit 500 indicated by the solid line.

In a situation where the position of the third reference nozzle Nc in the Y1 direction is shifted in the Y1 direction due to the positional shifting of the comparative head unit 500 and the position of the fourth reference nozzle Nd in the Y1 direction is shifted in the Y2 direction, the white stripe J2 may be generated in an image formed by dots formed by the ink discharged during the third pass and dots formed by the ink discharged during the fourth pass.

As described above, in the comparative head unit 500, the white stripe J2 may be generated without the black stripe J1 being generated, whereas in the first head unit 252_1, more specifically, in each head unit 252, the black stripe J1 may be generated or the white stripe J2 may be generated.

When the white stripe J2 is generated without black stripes J1 being generated, in the measures for white stripe J2, for example, in FIG. 12, a large amount of overlapping region where the position of the first head unit 252_1 in the Y1 direction indicated by the broken line and the position of the first head unit 252_1 in the Y1 direction indicated by the solid line overlap, is taken and the measures for adjusting the degree of thinning out dots in the overlapping region may be adopted according to the size of the distance $\alpha$.

On the other hand, in a case where the black stripe J1 is generated when dealing with only the measures for the white stripe J2 in a situation where the black stripe J1 may be generated and the white stripe J2 may be generated, the degree of thinning out dots in the overlapping region becomes large, and the number of useless nozzles that do not contribute to discharge the ink increases.

1-8. Relationship Between Head Unit and Color Ink

Figure 18:
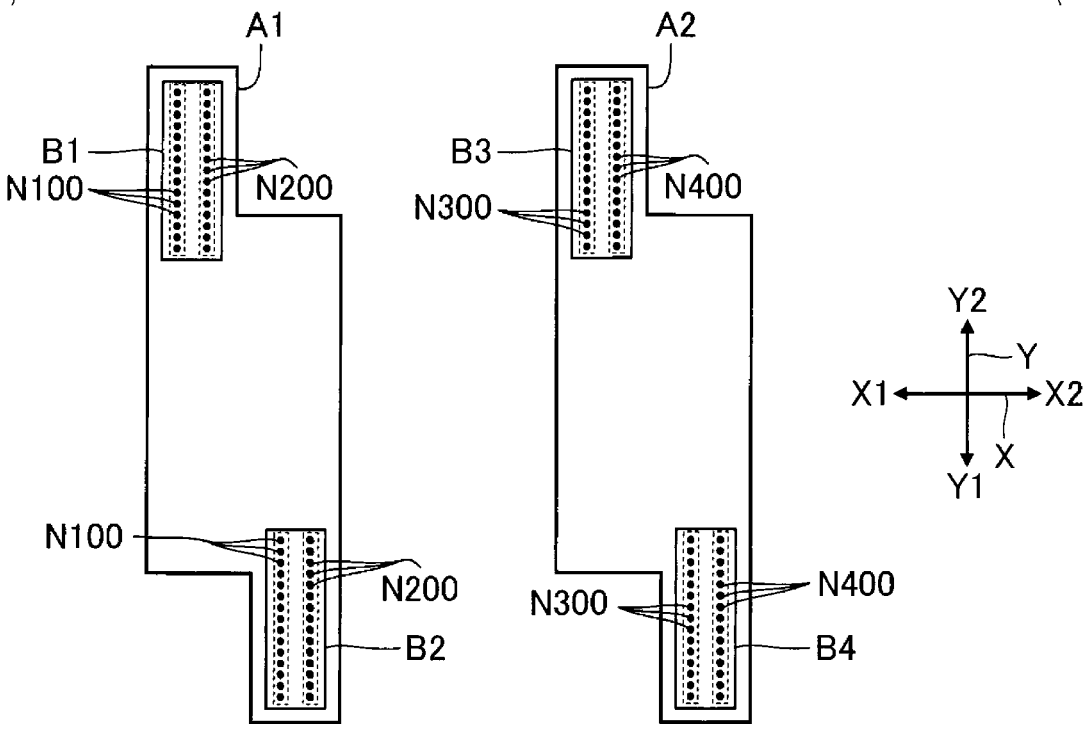
FIG. 18 is a diagram illustrating a comparative example.

FIG. 18 is a diagram illustrating a liquid discharging apparatus, which is different from that of the present embodiment and has a head unit A1 that discharges the yellow ink Y and the black ink K, and a head unit A2 that discharges the cyan ink C and the magenta ink M, as a comparative example.

The head unit A1 includes heads B1 and B2. Each of the heads B1 and B2 is provided with a plurality of nozzles N100 that discharge the yellow ink Y and a plurality of nozzles N200 that discharge the black ink K. The head unit A1 is provided with two other heads between the head B1 and the head B2 in the Y axis, but the description thereof is omitted for simplification of the description.

The head unit A2 includes heads B3 and B4. Each of the heads B3 and B4 is provided with a plurality of nozzles N300 that discharge the cyan ink C and a plurality of nozzles N400 that discharge the magenta ink M. The head unit A2 is provided with two other heads between the head B3 and the head B4 in the Y axis, but the description thereof is omitted for simplification of the description.

Also in the comparative example, the positional shifting occurs on a head unit basis as in the present embodiment. In FIG. 18, there is no positional shifting in each of the head units A1 and A2.

Figure 19:
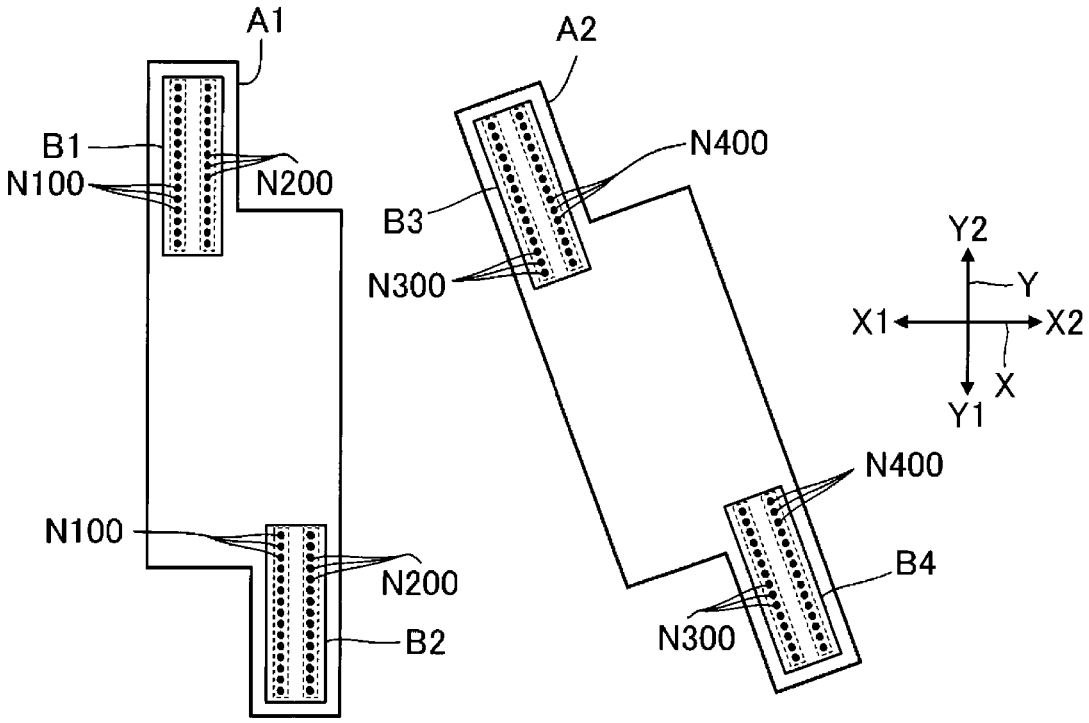
FIG. 19 is a diagram illustrating an example of a positional shifting in the comparative example.

FIG. 19 is a diagram illustrating an example in which the positional shifting occurs only in the head unit A2 of the head units A1 and A2. As described above, the positional shifting may occur in both the head units A1 and A2.

When the ink of colors that are different from each other is discharged from the common head unit, the shiftings of the ink of the respective colors are the same level with each other. That is, for ink belonging to the same head unit, when the positional shifting described with reference to FIGS. 11 to 15 occurs, the same level of shifting may occur in the direction along the Y axis. Specifically, in the yellow ink Y discharged from the head unit A1 and the black ink K discharged from the head unit A1, when the head unit A1 is rotated, the same level of shifting occurs in the direction along the Y axis. In the cyan ink C discharged from the head unit A2 and the magenta ink M discharged from the head unit A2, when the head unit A2 is rotated, the same level of shifting occurs in the direction along the Y axis.

In an image formed by the ink, it is acceptable that the yellow ink Y and the black ink K have the same level of shifting in the direction along the Y axis. However, in the image formed by the ink, it is not acceptable that the cyan ink C and the magenta ink M have the same level of shifting in the direction along the Y axis.

Furthermore, in an image formed by the ink, it is acceptable that a shifting is caused by the yellow ink Y in the direction along the Y axis. Further, in the image, it is also acceptable that a shifting is caused by the black ink K in the direction along the Y axis. However, in the image, it is not acceptable that the same shiftings are caused by the cyan ink C and the magenta ink M in the direction along the Y axis. Hereinafter, these points will be described.

First, the point will be described that it is acceptable that a shifting is caused by the yellow ink Y in the direction along the Y axis in the image.

The yellow ink Y has extremely high brightness as compared with the ink of other colors. Therefore, even when a shifting occurs in the yellow ink Y in the image, the shifting is not noticeable and does not significantly affect the deterioration in quality.

Next, the point will be described that it is also acceptable that a shifting is caused by the black ink K in the direction along the Y axis in the image.

Unlike the yellow ink Y, the black ink K has low brightness. Therefore, the shifting of the dots of the black ink K is easily noticeable.

Figure 20:
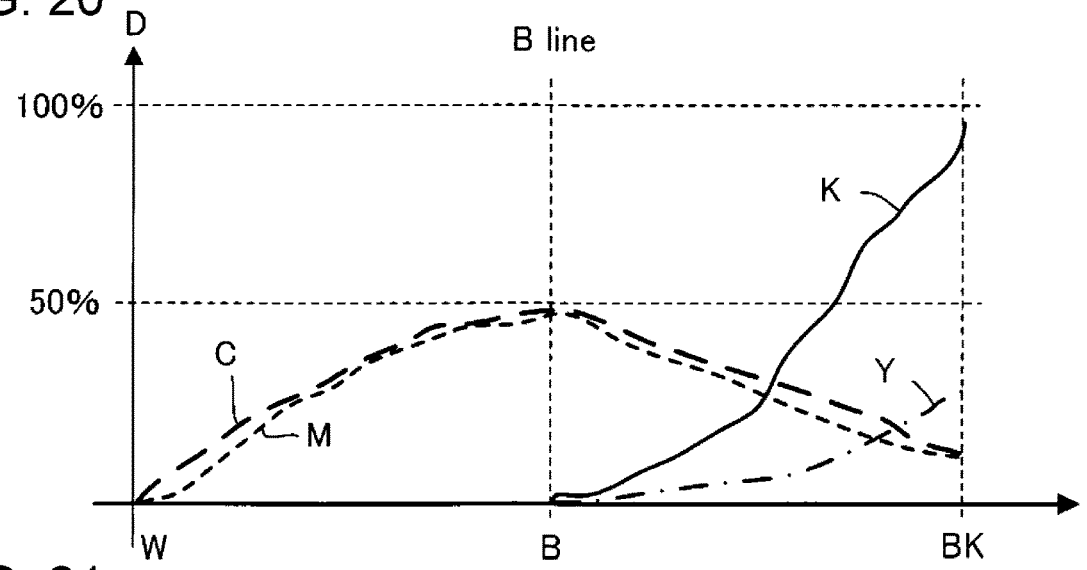
FIG. 20 is a diagram illustrating an example of a color conversion graph.
Figure 21:
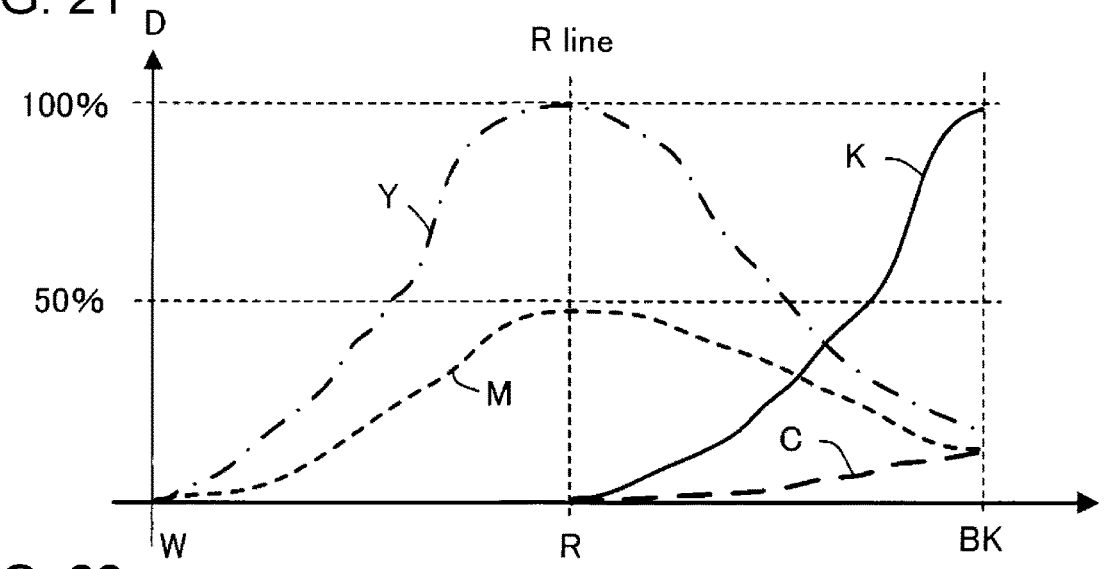
FIG. 21 is a diagram illustrating another example of a color conversion graph.
Figure 22:
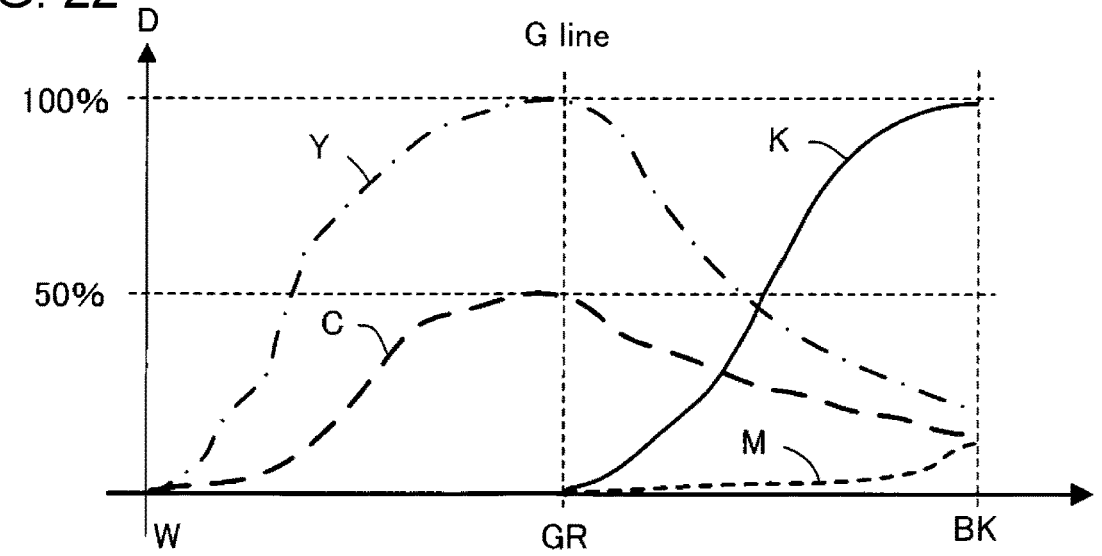
FIG. 22 is a diagram illustrating still another example of a color conversion graph.

The cyan ink C and the magenta ink M also have low brightness like the black ink K. As illustrated in FIGS. 20 to 22, the black ink K is used together with the cyan ink C, the magenta ink M, and the yellow ink Y. FIG. 20 is a diagram illustrating a ratio D of the discharging amount of the ink of each color used for reproducing a blue line which is a gradation of the color from the white W toward the black BK via the blue B, specifically, a ratio D of the discharging amount of each of the black ink K, the cyan ink C, the magenta ink M, and the yellow ink Y. FIG. 21 is a diagram illustrating a ratio D of the discharging amount of the ink of each color used for reproducing a red line which is a gradation of the color from the white W toward the black BK via the red R. FIG. 22 is a diagram illustrating a ratio D of the discharging amount of the ink of each color used for reproducing a green line which is a gradation of the color from the white W toward the black BK via the green GR. The ratio D of the discharging amount indicates the ratio of the discharging amount of each ink in each gradation, that is, the recording duty, when the discharging amount of the ink at the time the ink is applied to all pixels on the medium is 100%. Further, in FIGS. 20 to 22, W corresponds to (R, G, B)=(255, 255, 255), BK corresponds to (R, G, B)=(0, 0, 0), B corresponds to (R, G, B)=(0, 0, 255), R corresponds to (R, G, B)=(255, 0, 0), and G corresponds to (R, G, B)=(0, 255, 0).

For example, when the black BK is reproduced, the cyan ink C, the magenta ink M, and the yellow ink Y are used in addition to the black ink K in order to suppress a change in color tone.

Therefore, for example, even when the white stripe J2 or the black stripe J1 is generated in an image formed by the dots of the black ink K due to the positional shifting of the head unit A1, for example, when the positional shifting does not occur on the head unit A2, no white stripe J2 or black stripe J1 is generated in the image formed by the ink discharged from the head unit A2, specifically, in the image formed by the cyan ink C and the magenta ink M.

Therefore, even when the white stripe J2 or the black stripe J1 is generated in the image of the black ink K due to the positional shifting of the head unit A1, since the dots of the ink of two colors with low brightness discharged from the head unit A2, in which there is no positional shifting, are disposed at predetermined positions, the quality of the entire image is not significantly deteriorated.

The same applies when the head unit A2 discharges the cyan ink C and the yellow ink Y, or the magenta ink M and the yellow ink Y, instead of the cyan ink C and the magenta ink M. At least dots of either the cyan ink C or the magenta ink M can be disposed at the predetermined positions. Therefore, the deterioration in quality in the entire image is relatively small.

Next, the point will be described that it is not acceptable that the same shiftings are caused by the cyan ink C and the magenta ink M in the direction along the Y axis in the image.

Unlike the yellow ink Y, the cyan ink C and the magenta ink M have low brightness. Therefore, the shifting of dots of the cyan ink C and the shifting of dots of the magenta ink M are easily noticeable.

Regarding the cyan ink C and the magenta ink M, as illustrated in the region from the white W to the blue B in FIG. 20, it is often used only with the ink of two colors of the cyan ink C and magenta ink M.

Therefore, in an image formed only with the ink of two colors of the cyan ink C and the magenta ink M, when the white stripes J2 are generated in both the cyan ink C image and the magenta ink M image, and when the black stripes J1 are generated in both the cyan ink C image and the magenta ink M image, the quality of the image is deteriorated because it is not possible to suppress the deterioration in quality by the image with other ink. Therefore, in the image, it is not acceptable that the same shiftings are caused by the cyan ink C and the magenta ink M in the direction along the Y axis.

Hereinafter, this point will be described using a specific example with reference to FIGS. 23 to 32.

Figure 23:
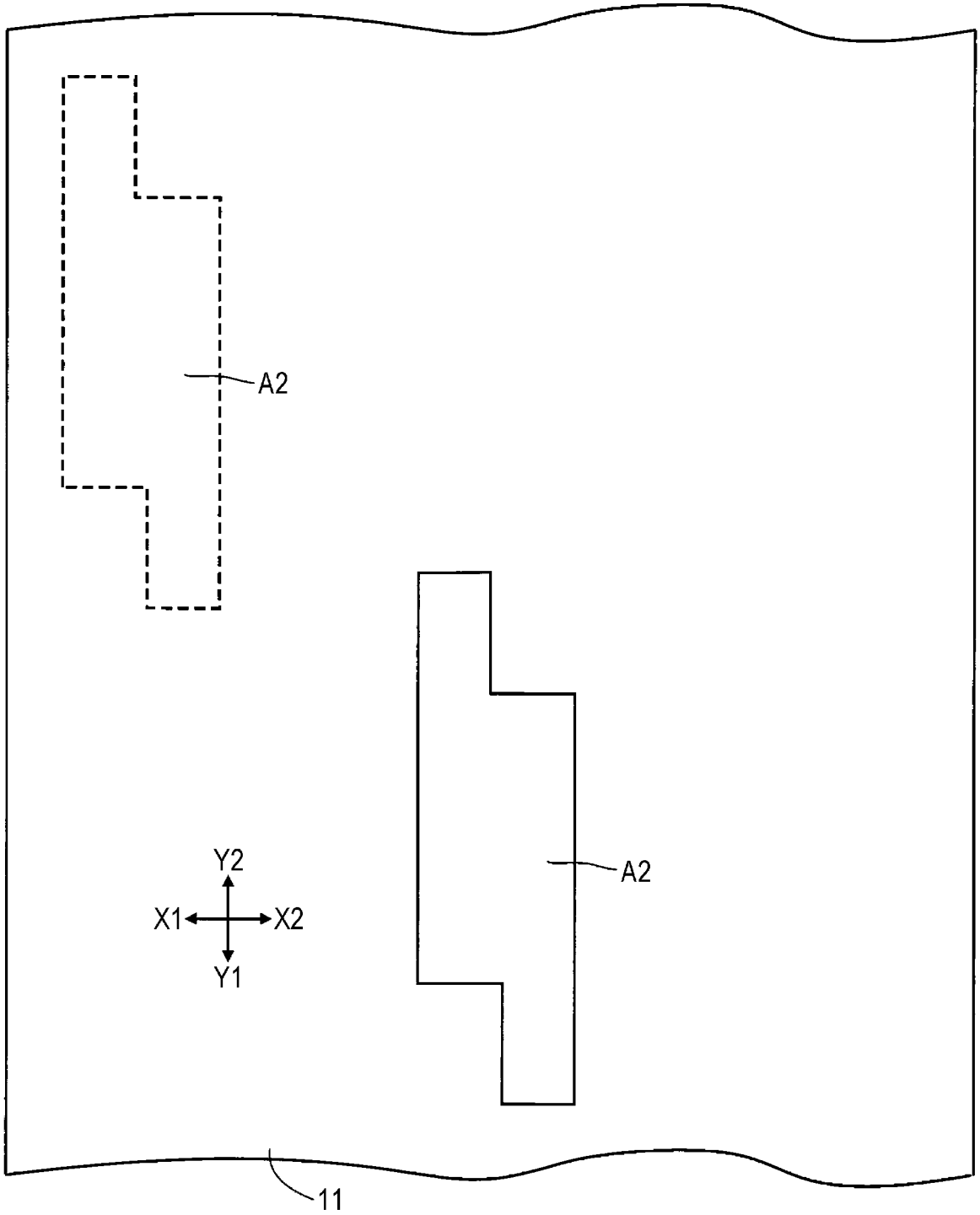
FIG. 23 is a diagram illustrating a relative positional relationship between a medium and the comparative example.

FIG. 23 is a diagram illustrating a situation where ink is discharged from the head unit A2 while reciprocating the head unit A2 along the X axis, and the medium 11 is transported along the Y axis by the relative positional relationship between the medium 11 and the head unit A2. Hereinafter, the movement of the head unit A2 in the X2 direction indicated by the broken line in FIG. 23 is referred to as "a fifth pass", and the movement of the head unit A2 in the X1 direction indicated by the solid line in FIG. 23 is referred to as "a sixth pass". The movement direction of the fifth pass may be the X1 direction. The movement direction of the sixth pass may be the X2 direction.

Figure 24:
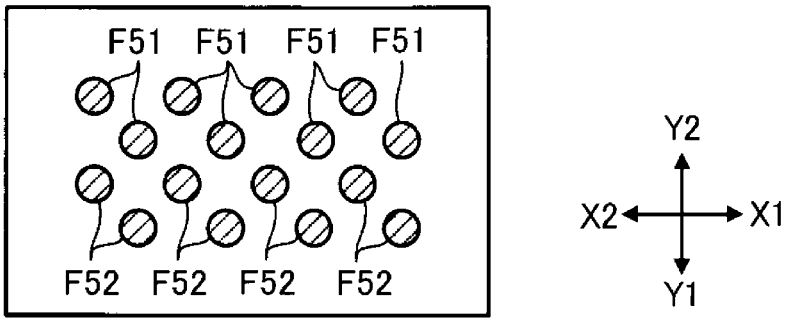
FIG. 24 is a diagram illustrating dots of cyan ink in a situation where there is no positional shifting.

FIG. 24 is a diagram illustrating dots F51 formed by the cyan ink C discharged during the fifth pass and dots F52 formed by the cyan ink C discharged during the sixth pass in a situation where there is no positional shifting in the head unit A2. When there is no positional shifting in the head unit A2, the positional relationship between the dots F51 and F52 is a designed positional relationship.

Figure 25:
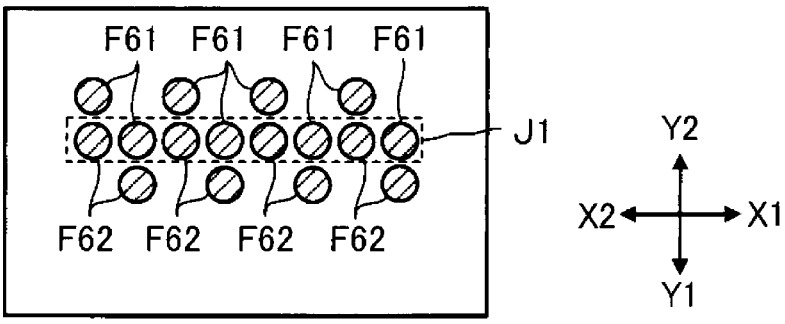
FIG. 25 is a diagram illustrating an example of dots of the cyan ink in a situation where there is a positional shifting.

FIG. 25 is a diagram illustrating an example in which a dots F61 formed by the cyan ink C discharged during the fifth pass and dots F62 formed by the cyan ink C discharged during the sixth pass overlap each other in the direction along the Y axis, in a situation where there is a positional shifting in the head unit A2. In FIG. 25, a black stripe J1 is generated. FIG. 25 illustrates a case where the head unit A2 is rotated clockwise, the landing position from the nozzle at the end portion on the Y1 side during the fifth pass is shifted in the Y1 direction, and the landing position from the nozzle at the end portion on the Y2 side during the sixth pass is shifted in the Y2 direction.

Figure 26:
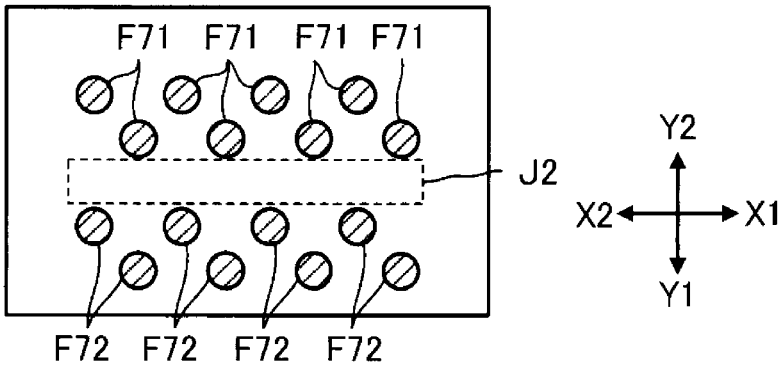
FIG. 26 is a diagram illustrating another example of dots of the cyan ink in a situation where there is a positional shifting.

FIG. 26 is a diagram illustrating an example in which the white stripe J2 is generated between a dots F71 formed by the cyan ink C discharged during the fifth pass and dots F72 formed by the cyan ink C discharged during the sixth pass, in a situation where there is a positional shifting in the head unit A2. FIG. 26 illustrates a case where the head unit A2 is rotated counterclockwise, the landing position from the nozzle at the end portion on the Y1 side during the fifth pass is shifted in the Y2 direction, and the landing position from the nozzle at the end portion on the Y2 side during the sixth pass is shifted in the Y1 direction.

Figure 27:
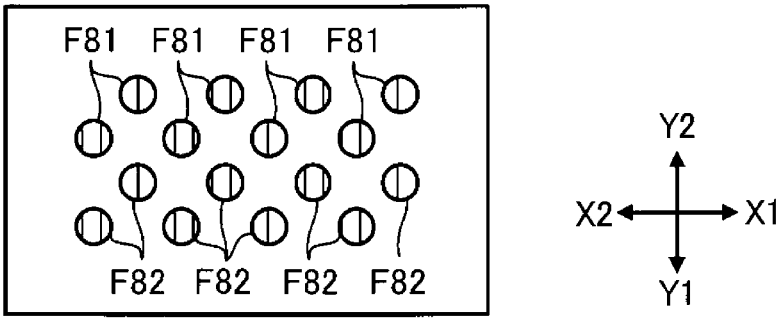
FIG. 27 is a diagram illustrating dots of magenta ink in a situation where there is no positional shifting.

FIG. 27 is a diagram illustrating dots F81 formed by the magenta ink M discharged during the fifth pass and dots F82 formed by the magenta ink M discharged during the sixth pass in a situation where there is no positional shifting in the head unit A2. When there is no positional shifting in the head unit A2, the positional relationship between the dots F81 and F82 is a designed positional relationship.

Figure 28:
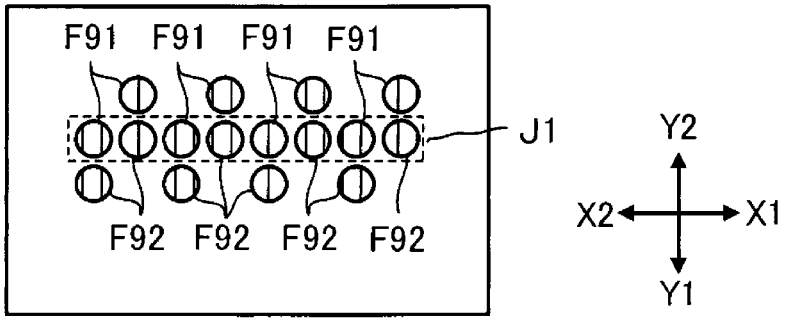
FIG. 28 is a diagram illustrating an example of dots of the magenta ink in a situation where there is a positional shifting.

FIG. 28 is a diagram illustrating an example in which a dots F91 formed by the magenta ink M discharged during the fifth pass and dots F92 formed by the magenta ink M discharged during the sixth pass overlap each other in the direction along the Y axis, in a situation where there is a positional shifting in the head unit A2. In FIG. 28, a black stripe J1 is generated. FIG. 28 illustrates a case where the head unit A2 is rotated clockwise, the landing position from the nozzle at the end portion on the Y1 side during the fifth pass is shifted in the Y1 direction, and the landing position from the nozzle at the end portion on the Y2 side during the sixth pass is shifted in the Y2 direction.

Figure 29:
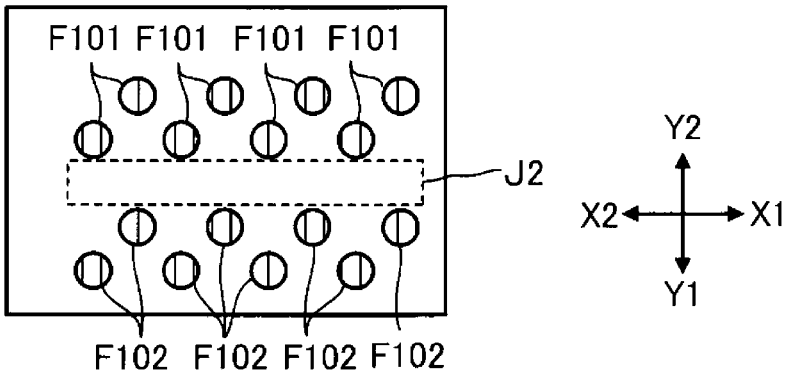
FIG. 29 is a diagram illustrating another example of dots of the magenta ink in a situation where there is a positional shifting.

FIG. 29 is a diagram illustrating an example in which the white stripe J2 is generated between a dots F101 formed by the magenta ink M discharged during the fifth pass and dots F102 formed by the magenta ink M discharged during the sixth pass, in a situation where there is a positional shifting in the head unit A2. FIG. 29 illustrates a case where the head unit A2 is rotated counterclockwise, the landing position from the nozzle at the end portion on the Y1 side during the fifth pass is shifted in the Y2 direction, and the landing position from the nozzle at the end portion on the Y2 side during the sixth pass is shifted in the Y1 direction.

When the cyan ink C and the magenta ink M are discharged from the common head unit A2, the shifting of the cyan ink C becomes the same level as the shifting of the magenta ink M in the image formed by the cyan ink C and the magenta ink M.

Figure 30:
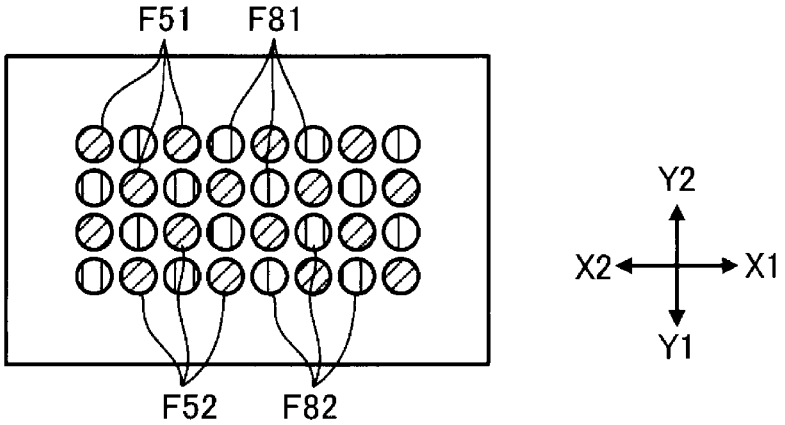
FIG. 30 is a diagram illustrating dots of the cyan ink and dots of the magenta ink in a situation where there is no positional shifting.

For example, when the dots F51 and F52 illustrated in FIG. 24 are formed by the cyan ink C, the dots F81 and F82 illustrated in FIG. 27 are formed by the magenta ink M. In this case, the image illustrated in FIG. 30 is formed by the dots F51, F52, F81, and F82.

Figure 31:
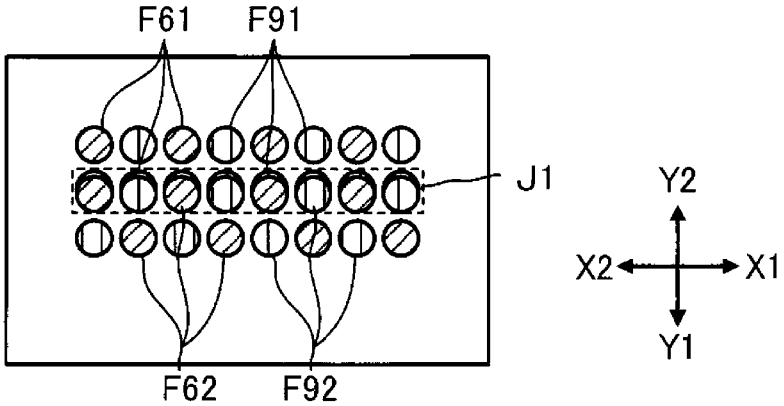
FIG. 31 is a diagram illustrating a comparative example of dots of the cyan ink and dots of the magenta ink in a situation where there is a positional shifting.

Further, when the dots F61 and F62 illustrated in FIG. 25 are formed by the cyan ink C, the dots F91 and F92 illustrated in FIG. 28 are formed by the magenta ink M. In this case, the image illustrated in FIG. 31 is formed by the dots F61, F62, F91, and F92. In FIG. 31, the black stripe J1 formed by the cyan ink C overlaps with the black stripe J1 formed by the magenta ink M, and the black stripe J1 is more noticeable as compared with when both of them do not overlap.

Figure 32:
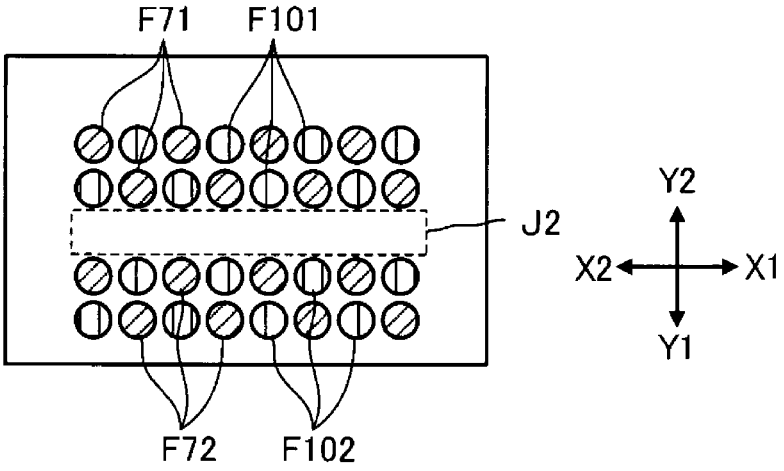
FIG. 32 is a diagram illustrating a comparative example of dots of the cyan ink and dots of the magenta ink in a situation where there is a positional shifting.

Further, when the dots F71 and F72 illustrated in FIG. 26 are formed by the cyan ink C, the dots F101 and F102 illustrated in FIG. 29 are formed by the magenta ink M. In this case, the image illustrated in FIG. 32 is formed by the dots F71, F72, F101, and F102. In FIG. 32, the white stripe J2 formed by the cyan ink C overlaps with the white stripe J2 formed by the magenta ink M, and the white stripe J2 is more noticeable as compared with when both of them do not overlap.

As can be seen from FIG. 21, when the colors are reproduced from the white W to the red R on the red line, it is often used only with the ink of two colors of the magenta ink M and yellow ink Y. Further, as can be seen from FIG. 22, when the colors are reproduced from the white W to the green GR on the green line, it is often used only with the ink of two colors of the cyan ink C and yellow ink Y.

However, as described above, the brightness of the yellow ink Y is extremely high.

Therefore, the level of the combined white stripes generated by combining the white stripes J2 generated in both the magenta ink M image and the yellow ink Y image is the same level as the level of the white stripes J2 generated in the magenta ink M image when the magenta is reproduced. The level of the combined black stripes generated by combining the black stripes J1 generated in both the magenta ink M image and the yellow ink Y image is the same level as the level of the black stripes J1 generated in the magenta ink M image when the magenta is reproduced.

The level of the combined white stripes generated by combining the white stripes J2 generated in both the cyan ink C image and the yellow ink Y image is the same level as the level of the white stripes J2 generated in the cyan ink C image when the cyan is reproduced. Further, the level of the combined black stripes generated by combining the black stripes J1 generated in both the cyan ink C image and the yellow ink Y image is the same level as the level of the black stripes J1 generated in the cyan ink C image when the cyan is reproduced.

In this way, considering the positional shifting of the head unit, it is not desirable to discharge the cyan ink C and the magenta ink M from the common head unit.

Therefore, in the present embodiment, the cyan ink C and the magenta ink M are discharged from different head units. Specifically, the cyan ink C is discharged from the first head unit 252_1 and the magenta ink M is discharged from the second head unit 252_2.

In this case, for example, even when the white stripe J2 or the black stripe J1 is generated in the image formed by the dots of the magenta ink M due to the positional shifting of the second head unit 252_2, for example, when the positional shifting does not occur on the first head unit 252_1, no white stripe J2 or black stripe J1 is generated in the image formed by the dots of the cyan ink C, and the quality of the entire image is not significantly deteriorated.

Figure 33:
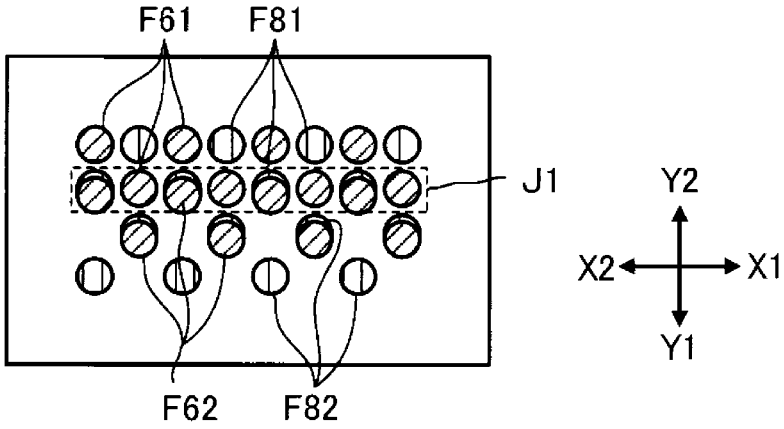
FIG. 33 is a diagram illustrating an example of dots of the cyan ink and dots of the magenta ink in a situation where there is a positional shifting.

FIG. 33 is a diagram illustrating an example of an image formed by an image having the black stripe J1 which is formed by dots F61 and F62 of the cyan ink C illustrated in FIG. 25 and an image that does not have the black stripe J1 or the white stripe J2 which are formed by dots F81 and F82 of the magenta ink M illustrated in FIG. 27. In this case, the quality is less deteriorated than the image illustrated in FIG. 31 in which the black stripes J1 overlap.

Figure 34:
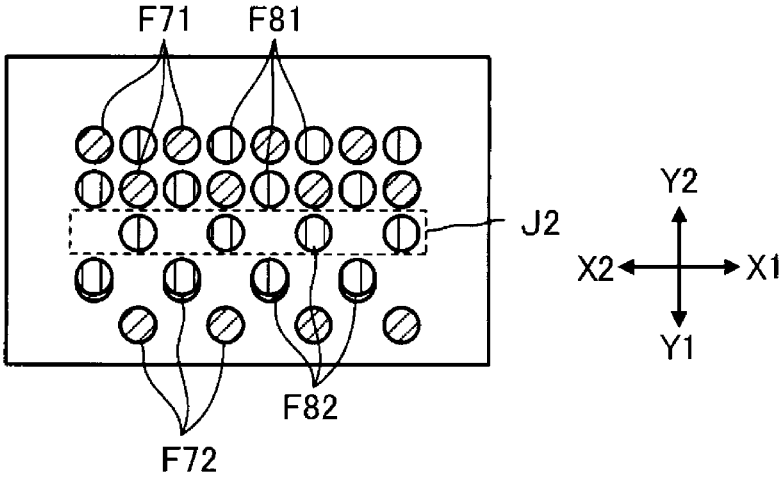
FIG. 34 is a diagram illustrating another example of dots of the cyan ink and dots of the magenta ink in a situation where there is a positional shifting.

FIG. 34 is a diagram illustrating an example of an image formed by an image having the white stripe J2 which is formed by dots F71 and F72 of the cyan ink C illustrated in FIG. 26 and an image that does not have the black stripe J1 or the white stripe J2 which are formed by dots F81 and F82 of the magenta ink M illustrated in FIG. 27. In this case, the quality is less deteriorated than the image illustrated in FIG. 32 in which the white stripes J2 overlap.

For example, when the level of positional shifting in the first head unit 252_1 is smaller than the level of positional shifting in the second head unit 252_2, it is possible to reduce the deterioration of the image quality as compared with the case where the level of positional shifting in the first head unit 252_1 is the same level as the level of positional shifting in the second head unit 252_2.

Further, for example, when the level of positional shifting in the second head unit 252_2 is smaller than the level of positional shifting in the first head unit 252_1, it is possible to reduce the deterioration of the image quality as compared with the case where the level of positional shifting in the second head unit 252_2 is the same level as the level of positional shifting in the first head unit 252_1.

1-9. Round-Up of First Embodiment

The liquid discharging apparatus 100 according to the present embodiment described above includes the following aspects.

The liquid discharging apparatus 100 has a first head unit 252_1 and a second head unit 252_2.

The first head unit 252_1 includes a first head H1 and a second head H2. The first head H1 has a plurality of first nozzles N1 that discharge cyan ink C, which is an example of a first color liquid, and a plurality of second nozzles N2 that discharge yellow ink Y, which is an example of a second color liquid. The second head H2 is provided with a plurality of third nozzles N3 that discharge the cyan ink C and a plurality of fourth nozzles N4 that discharge the yellow ink Y.

The second head unit 252_2 includes a third head H3 and a fourth head H4. The third head H3 has a plurality of fifth nozzles N5 that discharge magenta ink M, which is an example of a third color liquid, and a plurality of sixth nozzles N6 that discharge black ink K, which is an example of a fourth color liquid. The fourth head H4 is provided with a plurality of seventh nozzles N7 that discharge the magenta ink M and a plurality of eighth nozzles N8 that discharge the black ink K.

In the first head unit 252_1, the first head H1 and the second head H2 are at different positions from each other in the Y1 direction and are provided at different positions from each other in the X1 direction. The Y1 direction corresponds to "a first direction". The X1 direction corresponds to "a second direction". In the second head unit 252_2, the third head H3 and the fourth head H4 are at different positions from each other in the Y1 direction and are provided at different positions from each other in the X1 direction.

Therefore, in the liquid discharging apparatus 100 including the first head unit 252_1 that is provided with the first head H1 and the second head H2, in which the positions in Y1 direction are different and the positions in X1 direction are also different, the second head unit 252_2 that is provided with the third head H3 and the fourth head H4, in which the positions in Y1 direction are different and the positions in X1 direction are also different, the cyan ink C is discharged from the first head unit 252_1 and the magenta ink M is discharged from the second head unit 252_2.

Therefore, when the positional shifting occurs one of the first head unit 252_1 and the second head unit 252_2, and the positional shifting does not occur on the other of the first head unit 252_1 and the second head unit 252_2, it is possible to prevent the similar shifting from occurring in both the cyan ink C dots and the magenta ink M dots. Therefore, it is possible to reduce the deterioration in quality of the image generated by the liquid discharging apparatus 100.

Although yellow is used as the second color and black is used as the fourth color, black may be used as the second color and yellow may be used as the fourth color. In any case, it is possible to represent a formed object formed by using the cyan liquid, the magenta liquid, the yellow liquid, and the black liquid, for example, an image in color.

When yellow is used as the second color and black is used as the fourth color, the first head unit 252_1 discharges the cyan ink C and the yellow ink Y, and the second head unit 252_2 discharges the magenta ink M and the black ink K.

That is, the head unit that discharges the black ink K and the head unit that discharges the cyan ink C are different from each other.

As described above, the black ink K is used together with the magenta ink M and the cyan ink C. As can be seen from FIGS. 20 to 22, in a case where the magenta ink M and the cyan ink C are used together with the black ink K, when comparing a first color count, which is the number of colors reproduced by making the discharging amount of the cyan ink C larger than the discharging amount of the magenta ink M, and a second color count, which is the number of colors reproduced by making the discharging amount of the cyan ink C smaller than the discharging amount of the magenta ink M, the first color count is greater than the second color count.

Therefore, the configuration in which the head unit that discharges the black ink K and the head unit that discharges the cyan ink C are different from each other can make the black stripe J1 and the white stripe J2 formed by the black ink K less noticeable as compared with the case where the head unit that discharges the black ink K and the head unit that discharges the magenta ink M are different from each other.

As illustrated in FIGS. 4 and 5, the first head unit 252_1 has the first part U1, the second part U2, and the third part U3. Each of the second part U2 and the third part U3 has a shorter width than a width of the first part U1 in the X1 direction. The first part U1 is provided with a part of the plurality of first nozzles N1, a part of the plurality of second nozzles N2, a part of the plurality of third nozzles N3, and a part of the plurality of fourth nozzles N4. The second part U2 is provided with a part of the plurality of first nozzles N1 and a part of the plurality of second nozzles N2. The third part U3 is provided with a part of the plurality of third nozzles N3 and a part of the plurality of fourth nozzles N4. The second part U2 and the third part U3 are at different positions from each other in the Y1 direction and are provided at different positions from each other in the X1 direction.

As illustrated in FIGS. 7 and 8, the second head unit 252_2 has the fourth part U4, the fifth part U5, and the sixth part U6. Each of the fifth part U5 and the sixth part U6 has a shorter width than a width of the fourth part U4 in the X1 direction. The fourth part U4 is provided with a part of the plurality of fifth nozzles N5, a part of the plurality of sixth nozzles N6, a part of the plurality of seventh nozzles N7, and a part of the plurality of eighth nozzles N8. The fifth part U5 is provided with a part of the plurality of fifth nozzles N5 and a part of the plurality of sixth nozzles N6. The sixth part U6 is provided with a part of the plurality of seventh nozzles N7 and a part of the plurality of eighth nozzles N8. The fifth part U5 and the sixth part U6 are at different positions from each other in the Y1 direction and are provided at different positions from each other in the X1 direction.

Since the first part U1, the second part U2, the third part U3, the fourth part U4, the fifth part U5, and the sixth part U6 have the above-described relationship of width and position, the installation space for the first head unit 252_1 and the second head unit 252_2 can be reduced in the X1 direction as compared with the case where each of the first head units 252_1 and the second head unit 252_2 have a simple rectangular shape, for example.

As illustrated in FIGS. 4 and 5, each of the plurality of first nozzles N1, each of the plurality of second nozzles N2, each of the plurality of third nozzles N3, and each of the plurality of fourth nozzles N4 are provided in any of the first part U1, the second part U2, and the third part U3. As illustrated in FIGS. 7 and 8, each of the plurality of fifth nozzles N5, each of the plurality of sixth nozzles N6, each of the plurality of seventh nozzles N7, and each of the plurality of eighth nozzles N8 are provided in any of the fourth part U4, the fifth part U5, and the sixth part U6. That is, the nozzles N are not provided in a part other than the first part U1, the second part U2, the third part U3, the fourth part U4, the fifth part U5, and the sixth part U6. Therefore, it is easy to design the first head unit 252_1 and the second head unit 252_2 that can reduce the installation space as described above.

The second part U2 is coupled to the first part U1 in the Y2 direction with respect to the first part U1. That is, the second part U2 and the first part U1 are disposed in the order of the second part U2 and the first part U1 along the Y2 direction, and the first part U1 and the second part U2 are continuous. The third part U3 is coupled to the first part U1 in the Y1 direction with respect to the first part U1. That is, the third part U3 and the first part U1 are disposed in the order of the third part U3 and the first part U1 along the Y1 direction, and the first part U1 and the third part U3 are continuous. The first part U1 is positioned between the second part U2 and the third part U3. The fifth part U5 is coupled to the fourth part U4 in the Y2 direction with respect to the fourth part U4. That is, the fifth part U5 and the fourth part U4 are disposed in the order of the fifth part U5 and the fourth part U4 along the Y2 direction, and the fourth part U4 and the fifth part U5 are continuous. The sixth part U6 is coupled to the fourth part U4 in the Y1 direction with respect to the fourth part U4. That is, the sixth part U6 and the fourth part U4 are disposed in the order of the sixth part U6 and the fourth part U4 along the Y1 direction, and the fourth part U4 and the sixth part U6 are continuous. The fourth part U4 is positioned between the fifth part U5 and the sixth part U6. Since the first part U1, the second part U2, the third part U3, the fourth part U4, the fifth part U5, and the sixth part U6 are disposed as above, as described above, it is possible to reduce the installation space of the first head unit 252_1 and the second head unit 252_2 in the X1 direction.

As illustrated in FIG. 5, the end surface E2 of the second part U2 on the third side has the same position as the end surface E1*a* of the first part U1 on the third side in the X1 direction. The end surface E2 and the end surface E1*a* form a continuous plane. The end surface E2 and the end surface E1*a* form a straight line when viewed in the Z1 direction. The end surface E3 of the third part U3 on the fourth side has the same position as the end surface E1*b* of the first part U1 on the fourth side in the X1 direction. The end surface E3 and the end surface E1*b* form a continuous plane. The end surface E3 and the end surface E1*b* form a straight line when viewed in the Z1 direction.

As illustrated in FIG. 8, the end surface E5 of the fifth part U5 on the third side has the same position as the end surface E4*a* of the fourth part U4 on the third side in the X1 direction. The end surface E5 and the end surface E4*a* form a continuous plane. The end surface E5 and the end surface E4*a* form a straight line when viewed in the Z1 direction. The end surface E6 of the sixth part U6 on the fourth side has the same position as the end surface E4*b* of the fourth part U4 on the fourth side in the X1 direction. The end surface E6 and the end surface E4*b* form a continuous plane. The end surface E6 and the end surface E4*b* form a straight line when viewed in the Z1 direction.

Therefore, the end surface E2 and the end surface E1*a* form a flat surface, the end surface E3, and the end surface E1*b* form a flat surface, the end surface E5 and the end surface E4*a* form a flat surface, and the end surface E6 and the end surface E4*b* form a flat surface. Therefore, the first head unit 252_1 and the second head unit 252_2 can be densely disposed in the X1 direction with the configuration in which a step is provided at least one between the end surface E2 and the end surface E1*a*, between the end surface E3 and the end surface E1*b*, between the end surface E5 and the end surface E4*a*, and between the end surface E6 and the end surface E4*b*.

A part of the first head H1 is positioned in the second part U2, and the other part of the first head H1 is positioned in the first part U1. A part of the second head H2 is positioned in the third part U3, and the other part of the second head H2 is positioned in the first part U1. A part of the third head H3 is positioned in the fifth part U5, and the other part of the third head H3 is positioned in the fourth part U4. A part of the fourth head H4 is positioned in the sixth part U6, and the other part of the fourth head H4 is positioned in the fourth part U4. Therefore, a plurality of nozzles N that discharge the liquid of cyan and a plurality of nozzles N that discharge the second color liquid such as yellow can be evenly disposed across the first part U1, the second part U2, and the third part U3 along the Y axis. Further, a plurality of nozzles N that discharge the liquid of magenta and a plurality of nozzles N that discharge the fourth color liquid such as black can be evenly disposed across the fourth part U4, the fifth part U5, and the sixth part U6 along the Y axis.

As illustrated in FIG. 5, the first head unit 252_1 has a fifth head H5 and a sixth head H6 in addition to the first head H1 and the second head H2. The fifth head H5 and the sixth head H6 are positioned in the first part U1. The fifth head H5 is provided with a plurality of ninth nozzles N9 that discharge the cyan ink C and a plurality of tenth nozzles N10 that discharge the second color ink such as yellow. The sixth head H6 is provided with a plurality of eleventh nozzles N11 that discharge the cyan ink C and a plurality of twelfth nozzles N12 that discharge the second color ink.

As illustrated in FIG. 8, the second head unit 252_2 has a seventh head H7 and an eighth head H8 in addition to the third head H3 and the fourth head H4. The seventh head H7 and the eighth head H8 are positioned in the fourth part U4. The seventh head H7 is provided with a plurality of thirteenth nozzles N13 that discharge the magenta ink M and a plurality of fourteenth nozzles N14 that discharge the fourth color ink such as black. The eighth head H8 is provided with a plurality of fifteenth nozzles N15 that discharge the magenta ink M and a plurality of sixteenth nozzles N16 that discharge the fourth color ink.

In the configuration using the first head H1 to eighth head H8, compared to the configuration using only the first head H1 to the fourth head H4, it is possible to increase the number of nozzles N included in the first head unit 252_1 and the second head unit 252_2 without increasing the number of nozzles N in the first head H1 to the fourth head H4.

The first head unit 252_1 has a first holder 33*a* in which the first head H1 and the second head H2 are disposed. Therefore, the first head H1 and the second head H2 can be integrated by the first holder 33*a*. In addition to the first head H1 and the second head H2, the fifth head H5 and the sixth head H6 are also disposed in the first holder 33*a*. Therefore, the first head H1, the second head H2, the fifth head H5, and the sixth head H6 are integrated by the first holder 33*a*. The second head unit 252_2 has a second holder 33*b* in which the third head H3 and the fourth head H4 are disposed. Therefore, the third head H3 and the fourth head H4 can be integrated by the second holder 33*b*. In addition to the third head H3 and the fourth head H4, the seventh head H7, and the eighth head H8 are also disposed in the second holder 33*b*. Therefore, the third head H3, the fourth head H4, the seventh head H7, and the eighth head H8 are integrated by the second holder 33*b*.

The first head unit 252_1 has a first fixing plate 36*a* for fixing the first head H1 and the second head H2 to the first holder 33*a*. Therefore, it is possible to improve the integrity of the first head H1 and the second head H2 as compared with the configuration in which the first fixing plate 36*a* is not used. The first fixing plate 36*a* fixes the first head H1 and the second head H2 as well as the fifth head H5 and the sixth head H6 to the first holder 33*a*. Therefore, the integrity of the first head H1, the second head H2, the fifth head H5, and the sixth head H6 is enhanced. The second head unit 252_2 has a second fixing plate 36*b* for fixing the third head H3 and the fourth head H4 to the second holder 33*b*. Therefore, it is possible to enhance the integrity of the third head H3 and the fourth head H4, as compared with the configuration in which the second fixing plate 36*b* is not used. The second fixing plate 36*b* fixes not only the third head H3 and the fourth head H4 but also the seventh head H7 and the eighth head H8 to the second holder 33*b*. Therefore, the integrity of the third head H3, the fourth head H4, the seventh head H7, and the eighth head H8 is enhanced.

Each of the plurality of first nozzles N1, the plurality of second nozzles N2, the plurality of third nozzles N3, the plurality of fourth nozzles N4, the plurality of fifth nozzles N5, the plurality of sixth nozzles N6, the plurality of seventh nozzles N7, and the plurality of eighth nozzles N8 are arranged in the Y1 direction. Therefore, the installation space of the first head unit 252_1 and the second head unit 252_2 in the X1 direction can be reduced as compared with the configuration in which the nozzles N are arranged in different directions for each nozzle row.

2. Modification Example

The embodiment illustrated above may be variously modified. A specific aspect of modification that can be applied to the above-described embodiment is illustrated below. Any two or more aspects selected from the following examples can be appropriately combined within a range not inconsistent with each other.

1. In the above embodiment, the number of heads Hn included in the first head unit 252_1 and the number of heads Hm included in the second head unit 252_2 are four each, but the number of heads Hn included in the first head unit 252_1 and the number of heads Hm included in the second head unit 252_2 may be two, three, or five or more, each.

Figure 35:
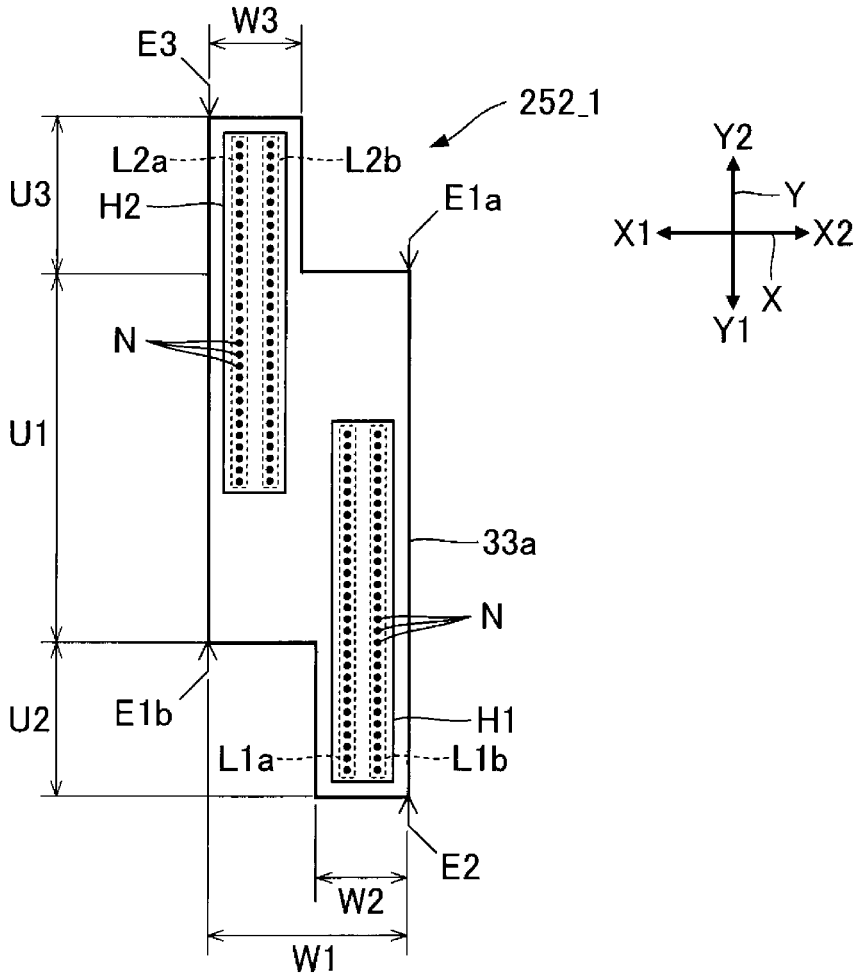
FIG. 35 is a plan view illustrating a first head unit in a modification example.

FIG. 35 is a plan view illustrating the first head unit 252_1 in the modification example. The first head unit 252_1 illustrated in FIG. 28 has a first head H1 and a second head H2. In the first head unit 252_1 illustrated in FIG. 28, the first head H1 overlaps the second head H2 in the Y1 direction. The nozzle row Lia overlaps the nozzle row L2*a* in the Y1 direction. The nozzle row Lib overlaps the nozzle row L2*b* in the Y1 direction.

Figure 36:
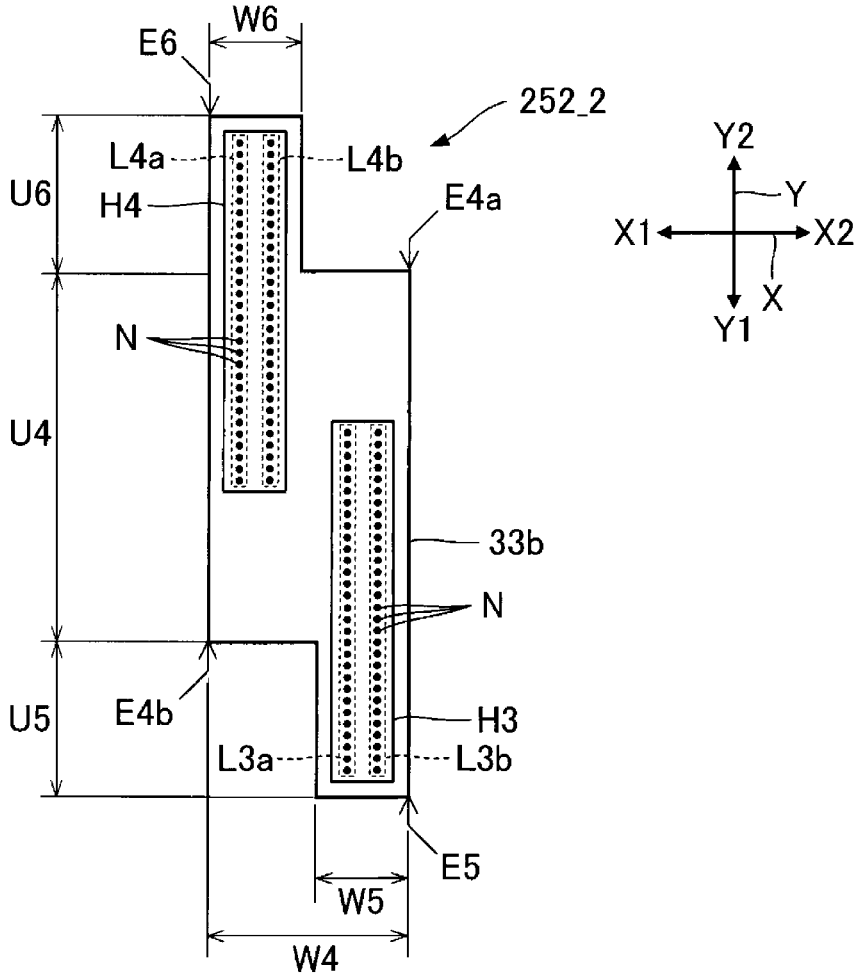
FIG. 36 is a plan view illustrating a second head unit in the modification example.

FIG. 36 is a plan view illustrating the second head unit 252_2 in the modification example. The second head unit 252_2 illustrated in FIG. 29 has a third head H3 and a fourth head H4. In the second head unit 252_2 illustrated in FIG. 29, the third head H3 overlaps the fourth head H4 in the Y1 direction. The nozzle row L3*a* overlaps the nozzle row L4*a* in the Y1 direction. The nozzle row L3*b* overlaps the nozzle row L4*b* in the Y1 direction. According to the above modification example, the same effect as the above-described embodiment can be obtained.

2. Hereinafter, when it is not necessary to distinguish the heads Hn and Hm from each other, they are referred to as "head H". In the above-described embodiment, the configuration in which the plurality of heads H are formed by laminating a plurality of substrates such as a nozzle substrate, a reservoir substrate, a pressure chamber substrate, and an element substrate has been described as an example.

However, one or more of substrates, among the nozzle substrate, the reservoir substrate, the pressure chamber substrate, and the element substrate, may be individually provided for each head H, and the other substrates may be common for the plurality of heads H. For example, when the nozzle substrate is provided individually for each head H, one or more substrates, among the reservoir substrate, the pressure chamber substrate, and the element substrate, may be commonly provided for the plurality of heads H. Further, when the reservoir substrate and the pressure chamber substrate are individually provided for each head H, the nozzle substrate or the like may be provided commonly for the plurality of heads H.

3. In the above-described embodiment, a sub tank 13 is provided separately from the first head unit 252_1 and the second head unit 252_2 and the ink is circulated among the first head unit 252_1 and the second head unit 252_2 and the sub tank 13, but it does not have to be a sub tank 13, it suffices that the ink is circulated between the elements different from the first head unit 252_1 and the second head unit 252_2. For example, the ink may be circulated among the first head unit 252_1 and the second head unit 252_2 and the liquid container 12.

4. In the above-described embodiment, the ink is circulated among the first head unit 252_1 and the second head unit 252_2 and the sub tank 13, but the mechanism for circulating the ink among the first head unit 252_1 and the second head unit 252_2 and the sub tank 13 may not be provided.

5. In the above-described embodiment, the first holder 33*a* is provided with the first head H1, the second head H2, the fifth head H5, and the sixth head H6, but at least the first head H1 and the second head H2 may be disposed in the first holder 33*a*.

Further, the second holder 33*b* is provided with the third head H3, the fourth head H4, the seventh head H7, and the eighth head H8, but at least the third head H3 and the fourth head H4 may be disposed in the second holder 33*b*.

6. In the above-described embodiment, "a first direction" and "a second direction" are orthogonal to each other, but they do not have to be orthogonal to each other as long as they intersect.

7. In the above-described embodiment, each of the plurality of first nozzles N1, the plurality of second nozzles N2, the plurality of third nozzles N3, the plurality of fourth nozzles N4, the plurality of fifth nozzles N5, the plurality of sixth nozzles N6, the plurality of seventh nozzles N7, and the plurality of eighth nozzles N8 are arranged in the Y1 direction.

However, at least one of the plurality of first nozzles N1, the plurality of second nozzles N2, the plurality of third nozzles N3, the plurality of fourth nozzles N4, the plurality of fifth nozzles N5, the plurality of sixth nozzles N6, the plurality of seventh nozzles N7, and the plurality of eighth nozzles N8 may not be arranged in the Y1 direction. For example, at least one of the plurality of first nozzles N1, the plurality of second nozzles N2, the plurality of third nozzles N3, the plurality of fourth nozzles N4, the plurality of fifth nozzles N5, the plurality of sixth nozzles N6, the plurality of seventh nozzles N7, and the plurality of eighth nozzles N8 may be arranged in a direction intersecting each of the X axis and the Y axis in the XY plane.

8. In the above embodiment, the direction in which the medium 11 is transported and the direction in which the first head unit 252_1 and the second head unit 252_2 are arranged are the same, but the directions may be different from each other. For example, the direction in which the medium 11 is transported may be orthogonal to the direction in which the first head unit 252_1 and the second head unit 252_2 are arranged.

9. In the above embodiment, the first head unit 252_1 and the second head unit 252_2 have the same shape, but the head units may be different from each other.

10. In the above-described embodiment, the serial type liquid discharging apparatus in which the transporting body 241 having the head module 25 mounted thereon is reciprocated has been exemplified, but the present disclosure can be applied to a line type liquid discharging apparatus in which a plurality of nozzles N are distributed over the entire width of the medium 11.

11. The liquid discharging apparatus exemplified in the above-described embodiment can be adopted not only in an apparatus dedicated to printing but also in various apparatus such as a facsimile apparatus and a copying machine. Moreover, the application of the liquid discharging apparatus is not limited to printing. For example, a liquid discharging apparatus that discharges a solution of a coloring material is utilized as a manufacturing apparatus that forms a color filter of a display apparatus such as a liquid crystal display panel. Further, a liquid discharging apparatus that discharges a solution of a conductive material is utilized as a manufacturing apparatus that forms wiring or electrodes of a wiring substrate. Further, a liquid discharging apparatus that discharges a solution of an organic substance related to a living body is utilized, for example, as a manufacturing apparatus that manufactures a biochip.

What is claimed is:

1. A liquid discharging apparatus for discharging a liquid, comprising:

a first head unit including a first head that is provided with a plurality of first nozzles that discharge the liquid of a first color and a plurality of second nozzles that discharge the liquid of a second color, and a second head that is provided with a plurality of third nozzles that discharge the liquid of the first color and a plurality of fourth nozzles that discharge the liquid of the second color; and a second head unit including a third head that is provided with a plurality of fifth nozzles that discharge the liquid of a third color and a plurality of sixth nozzles that discharge the liquid of a fourth color, and a fourth head that is provided with a plurality of seventh nozzles that discharge the liquid of the third color and a plurality of eighth nozzles that discharge the liquid of the fourth color, wherein the first head unit has a first part, a second part that is coupled to the first part on a first side in a first direction and has a width shorter than a width of the first part in a second direction intersecting the first direction, and a third part that is coupled to the first part on a second side opposite to the first side in the first direction, has a width shorter than the width of the first part in the second direction, and is provided at a position different from the second part in the second direction, the second head unit has a fourth part, a fifth part that is coupled to the fourth part on the first side in the first direction and has a width shorter than a width of the fourth part in the second direction, and a sixth part that is coupled to the fourth part on the second side in the first direction, has a width shorter than the width of the fourth part in the second direction, and is provided at a position different from the fifth part in the second direction, a part of the first head is positioned in the second part, a part of the second head is positioned in the third part, a part of the third head is positioned in the fifth part, a part of the fourth head is positioned in the sixth part, and the first color is cyan and the third color is magenta.

2. The liquid discharging apparatus according to claim 1, wherein the second color is one of yellow and black, and the fourth color is the other of yellow and black.

3. The liquid discharging apparatus according to claim 1, wherein the second color is yellow and the fourth color is black.

4. The liquid discharging apparatus according to claim 1, wherein each of the plurality of first nozzles, each of the plurality of second nozzles, each of the plurality of third nozzles, and each of the plurality of fourth nozzles are provided in any of the first part, the second part, and the third part, and each of the plurality of fifth nozzles, each of the plurality of sixth nozzles, each of the plurality of seventh nozzles, and each of the plurality of eighth nozzles are provided in any of the fourth part, the fifth part, and the sixth part.

5. The liquid discharging apparatus according to claim 1, wherein an end surface of the second part on a third side in the second direction has the same position, in the second direction, as an end surface of the first part on the third side in the second direction, an end surface of the third part on a fourth side opposite to the third side in the second direction has the same position, in the second direction, as an end surface of the first part on the fourth side in the second direction, an end surface of the fifth part on the third side in the second direction has the same position, in the second direction, as an end surface of the fourth part on the third side in the second direction, and an end surface of the sixth part on the fourth side in the second direction has the same position, in the second direction, as an end surface of the fourth part on the fourth side in the second direction.

6. The liquid discharging apparatus according to claim 1, wherein the other part of the first head is positioned in the first part, the other part of the second head is positioned in the first part, the other part of the third head is positioned in the fourth part, and the other part of the fourth head is positioned in the fourth part.

7. The liquid discharging apparatus according to claim 1, wherein the first head unit further includes a fifth head provided with a plurality of ninth nozzles that discharge the liquid of the first color and a plurality of tenth nozzles that discharge the liquid of the second color, and a sixth head provided with a plurality of eleventh nozzles that discharge the liquid of the first color and a plurality of twelfth nozzles that discharge the liquid of the second color, the second head unit further includes a seventh head provided with a plurality of thirteenth nozzles that discharge the liquid of the third color and a plurality of fourteenth nozzles that discharge the liquid of the fourth color, and an eighth head provided with a plurality of fifteenth nozzles that discharge the liquid of the third color and a plurality of sixteenth nozzles that discharge the liquid of the fourth color, the fifth head and the sixth head are positioned in the first part, and the seventh head and the eighth head are positioned in the fourth part.

8. The liquid discharging apparatus according to claim 1, wherein the first head unit and the second head unit are arranged side by side in the second direction.

9. The liquid discharging apparatus according to claim 1, further comprising:

a transporting mechanism transporting a medium on which the liquid is discharged along the first direction.

10. The liquid discharging apparatus according to claim 1, wherein the first head unit further includes a first holder in which the first head and the second head are disposed, and the second head unit further includes a second holder in which the third head and the fourth head are disposed.

11. The liquid discharging apparatus according to claim 10, wherein the first head unit further includes a first fixing plate that fixes the first head and the second head to the first holder, and the second head unit further includes a second fixing plate that fixes the third head and the fourth head to the second holder.

12. The liquid discharging apparatus according to claim 1, wherein each of the plurality of first nozzles, the plurality of second nozzles, the plurality of third nozzles, the plurality of fourth nozzles, the plurality of fifth nozzles, the plurality of sixth nozzles, the plurality of seventh nozzles, and the plurality of eighth nozzles are arranged in the first direction.

* * * * *